US007032762B2

(12) United States Patent
Miyazaki et al.

(10) Patent No.: US 7,032,762 B2
(45) Date of Patent: Apr. 25, 2006

(54) POWER-ASSISTED MOVABLE RACK

(75) Inventors: Kunio Miyazaki, Kumamoto (JP); Tomoyuki Kawano, Kumamoto (JP); Kazuya Tokunaga, Kumamoto (JP); Ichiro Ikenaga, Kumamoto (JP); Toshihiro Higashi, Kumamoto (JP)

(73) Assignee: Kongo Co., Ltd., Kumamoto (JP)

( * ) Notice: Subject to any disclaimer, the term of this patent is extended or adjusted under 35 U.S.C. 154(b) by 11 days.

(21) Appl. No.: 10/399,787

(22) PCT Filed: Aug. 27, 2001

(86) PCT No.: PCT/JP01/07293

§ 371 (c)(1),
(2), (4) Date: Apr. 28, 2003

(87) PCT Pub. No.: WO02/34086

PCT Pub. Date: May 2, 2002

(65) Prior Publication Data

US 2004/0004051 A1 Jan. 8, 2004

(30) Foreign Application Priority Data

Oct. 26, 2000 (JP) ..... 2000-327067
Oct. 31, 2000 (JP) ..... 2000-333002

(51) Int. Cl.
*E05D 15/22* (2006.01)

(52) U.S. Cl. ..... 211/162; 211/1.51; 211/1.52

(58) Field of Classification Search ..... 211/162, 211/1.52, 1.51, 121; 312/198; 108/96; 104/147
See application file for complete search history.

(56) References Cited

U.S. PATENT DOCUMENTS

| | | | | |
|---|---|---|---|---|
| 3,168,361 | A * | 2/1965 | Naito et al. | 312/199 |
| 3,566,802 | A * | 3/1971 | Lundgvist | 104/172.3 |
| 3,575,298 | A * | 4/1971 | Ruoss | 211/1.57 |
| 3,597,034 | A | 8/1971 | Wetzler | |
| 3,640,595 | A * | 2/1972 | Staller et al. | 312/198 |
| 3,890,903 | A * | 6/1975 | Showell | 104/295 |
| 3,957,323 | A * | 5/1976 | Tucker et al. | 312/198 |
| 4,017,131 | A * | 4/1977 | Camenisch | 312/198 |
| 4,033,649 | A * | 7/1977 | Naito et al. | 312/201 |
| 4,039,040 | A * | 8/1977 | Spears et al. | 104/288 |
| 4,307,922 | A * | 12/1981 | Rhodes, Jr. | 312/198 |
| 4,412,772 | A * | 11/1983 | Naito et al. | 312/199 |
| 4,437,711 | A * | 3/1984 | Dahnert | 312/201 |
| 4,441,617 | A * | 4/1984 | Forsberg | 211/1.57 |
| 4,643,418 | A * | 2/1987 | Bart | 482/5 |

(Continued)

FOREIGN PATENT DOCUMENTS

| | | |
|---|---|---|
| GB | 1093640 | 12/1967 |
| JP | 45-12346 | 5/1970 |

(Continued)

*Primary Examiner*—Jerry Redman
(74) *Attorney, Agent, or Firm*—Oblon, Spivak, McClelland, Maier & Neustadt, P.C.

(57) ABSTRACT

The invention provides a relatively simple and inexpensive power-assisted movable rack system, movement of which is controlled by an operator. The movable rack system comprises a plurality of movable racks, each of which includes a plurality of wheels, a DC motor turning forward or backward and reciprocating the movable rack, a pair of direction switches provided at opposite positions in moving directions of the movable rack, and an actuating circuit rotating the DC motor in one direction during the operation of one of the direction switches and rotating the DC motor in an opposite direction during the operation of the other direction switch. The DC motor applies dynamic braking force, so that movable racks can be stopped with a short braking distance.

3 Claims, 25 Drawing Sheets

U.S. PATENT DOCUMENTS

| | | | | |
|---|---|---|---|---|
| 4,759,592 | A * | 7/1988 | Dahnert | 312/201 |
| 4,783,618 | A * | 11/1988 | Artrip | 318/587 |
| 5,160,190 | A * | 11/1992 | Farrell et al. | 312/201 |
| 5,842,585 | A * | 12/1998 | Hollander | 211/162 |
| 6,112,917 | A * | 9/2000 | Baker et al. | 211/162 |
| 6,202,861 | B1 * | 3/2001 | Mah | 211/40 |
| 6,845,834 | B1 * | 1/2005 | Hatanaka | 180/167 |

FOREIGN PATENT DOCUMENTS

| | | |
|---|---|---|
| JP | 51-96711 | 8/1976 |
| JP | 55-113415 | 9/1980 |
| JP | 62-26101 | 2/1987 |
| JP | 64-16837 | 1/1989 |
| JP | 10-262748 | 10/1998 |
| JP | 11-99021 | 4/1999 |

* cited by examiner

POWER-ASSISTED MOVABLE RACK

FIELD OF THE INVENTION

This invention relates to a power-assisted movable rack system which is manually operated with movable racks activated by electric motors using a simplified circuit.

DESCRIPTION OF THE RELATED ART

In the related art, movable racks are moved by wheels attached thereon. When a plurality of such movable racks are arranged, a work space can be formed only in front of a movable rack to or from which articles are to be loaded or unloaded while the remaining racks can remain in a conglomerated state. Therefore, the movable racks are very effective in storing articles in a limited space.

The existing movable racks are classified into those which are manually moved by an operator, those which are moved using a rotary handle for rotating wheels, and those which are driven by electric motors. The purely manual type movable racks are used in a small scale, so that the rotary handle type movable racks and power-driven movable racks are usually in wide use.

With the rotary handle type movable racks, rotating force of the rotary handle is transmitted to the wheels via a transmission system having a speed reduction gear train. Therefore, relatively large movable racks can be moved by the operator. Further, a plurality of movable racks can be moved by turning a rotary handle of only a single movable rack. However, a considerable amount of force is required in order to move very large movable racks. Recently, a number of such movable racks have been widely used in libraries or the like, so that they are frequently moved by female workers who are considered to be weaker than male workers, which is very burdensome to female workers.

Conversely, the power-driven movable racks are provided with electric motors depending upon their sizes, and can be easily operated by females and males. However, such power-driven movable racks suffer from the following problems. It is assumed here that a command is issued in order to form a work space between certain movable racks. Movable racks to be moved and their moving directions should be calculated on the basis of a position of a proposed work space and a position of a space to which the movable racks can be moved. Thereafter, it is necessary to determine electric motors to be activated and rotating directions of the electric motors. This means that complicated software is required for a control circuit or for controlling the electric motors. Further, if individual movable racks have no available spaces to which they should move, it is necessary to detect such a state and to stop them. Still further, if any person or article is detected in the spaces to which the movable racks are being moved, the movable racks have to be stopped. Finally, in order to secure safety and protect the electric motors, a variety of detection circuits and control circuits should be provided, which inevitably makes the power-driven movable racks rather expensive than the rotary handle type movable racks.

From another viewpoint, each movable rack is usually moved on straight guide rails which are usually approximately one meter long at most. A maximum moving speed is approximately 4 km/h, which is substantially equal to a walking speed of the man. Although the movement of the movable racks is simple, the power-driven movable racks have to be controlled in a complicated manner, and should have a complicated circuit configuration or software. This means that the power-driven movable racks are very expensive. Further, the power-driven movable racks are so slow that they take approximately 16 seconds in order to form a work space having a length of 900 mm to 1,000 mm while the rotary handle type movable racks of the related art take approximately 8 seconds. This inevitably reduces the work efficiency of the power-driven movable racks.

The inventor has proposed in Japanese Patent Application No. 11-136,932 a power-assisted movable rack, which comprises a rotary handle, a power transmission mechanism for transmitting rotary force of the rotary handle to wheels, and electric motors for applying rotary force to the wheels when torque applied to the rotary handle becomes larger than a predetermined value.

The foregoing power-assisted movable rack looks like a rotary handle type movable rack, but can be moved with small rotary force when assisted by an electric motor even if the movable rack is very heavy.

SUMMARY OF THE INVENTION

It is therefore a first object of the invention to provide a power-assisted movable rack system which is designed on the basis of the technical concept of the related art, is moved under the control of an operator, and includes a simple and inexpensive control circuit.

A second object of the invention is to provide a power-assisted movable rack system which can be moved speedily, reduce a standby time when forming a work space and improve work efficiency.

It is a third object of the invention to provide a power-assisted movable rack system in which a plurality of movable racks can be speedily moved at the same time in order to form a work space.

A fourth object of the invention is to provide a power-assisted movable rack system which can be quickly stopped even when articles are heavily and not uniformly loaded.

Finally, the invention is intended to provide a power-assisted movable rack system in which a normal stop and an emergency stop of movable racks can be distinguished, and in which an emergency stopping distance can be reduced compared with a normal stopping distance.

The invention provides a power-assisted movable rack system comprising a plurality of movable racks. Each of the movable rack includes: a plurality of wheels; a DC motor turning forward or backward and reciprocating the movable rack; a pair of direction switches provided at opposite positions in moving directions of the movable rack; and an actuating circuit rotating the DC motor in one direction during the operation of one of the direction switches and rotating the DC motor in an opposite direction during the operation of the other direction switch.

An operator can move movable racks in opposite directions by operating direction switches as he or she desires.

The DC motor functioning as a drive source has a maximum start torque and can activate movable racks with a reduced speed reduction ratio, so that movable racks can be moved at a high speed. Further, the DC motor can apply maximum dynamic braking to movable racks, which enables the movable racks to stop with a short braking distance.

Further, the invention provides a power-assisted movable rack, which comprises a plurality of movable racks, each of which includes: a plurality of wheels; a DC motor turning forward or backward and reciprocating the movable rack; a pair of right and left direction switches provided at opposite side edges in moving directions of the movable rack; and an actuating circuit rotating the DC motor in one direction during the operation of the right direction switch for the purpose of moving the movable rack to the right, and rotating the DC motor in an opposite direction during the operation of the left direction switch for purpose of moving the movable rack to the left. The movable racks are juxtaposed. One movable rack is capable of moving other movable racks; a signal transmitter is included for sending a rightward signal to a right driven movable rack when the right direction switch is operated on a driving movable rack, and sending a leftward signal to a left driven movable rack when the left direction switch is operated on the driving movable rack; and the actuating circuit provides power to the right or left driven movable rack receiving the rightward or leftward signal, the power being smaller than power applied to the driving movable rack.

In a movable rack where either the left or right direction switch is operated, the DC motor associated with the operated switch is actuated in order to move the movable rack (functioning as a driving movable rack) to the left or right. A movable rack which is left or right to the driving movable rack is also moved. Power which is smaller than that applied to the driving movable rack is applied to the movable rack moved by the driving movable rack, so that running torque is generated in the movable rack moved by the driving movable rack. This is effective in reducing loads applied to the DC motor functioning as a drive source.

DESCRIPTION OF THE EMBODIMENTS

Figure 1:
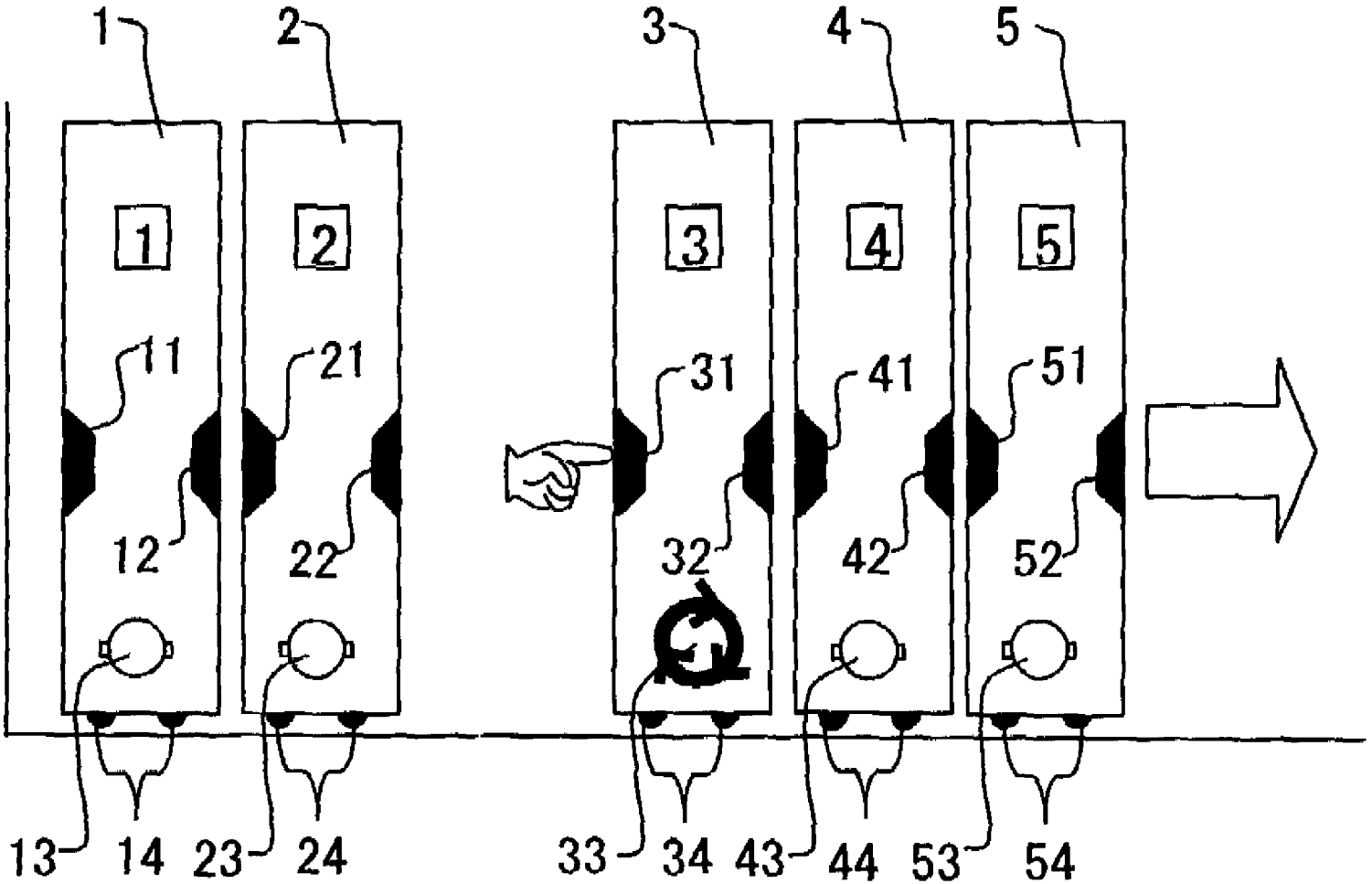
FIG. 1 is a side elevation of a power-assisted movable rack system including a plurality of movable racks according to a first embodiment of the invention.

The invention will be described with reference to the preferred embodiments shown in the accompanying drawings. Referring to FIG. 1, movable racks 1 to 5 are provided with wheels 14, 24, 34, 44 and 54, and electric motors 13, 23, 33, 43 and 53, respectively. The electric motors 13, 23, 33, 43 and 53 are used to turn the wheels 14, 24, 34, 44 and 54, which run on rails laid on a floor.

In an example of FIG. 1, frontages of each movable rack through which articles are loaded or unloaded are at right angles to the plane of the drawing sheet of FIG. 1, so that the movable racks are moved in the direction which is at right angles to the front surfaces thereof (i.e. to the left or right in parallel to the plane of FIG. 1). In this specification, the frontages of individual movable racks are either a front or rear surface thereof, while the vertical faces at right angles to the frontages are side surfaces, which are visible in FIG. 1.

The electric motors 13, 23, 33, 43 and 53 are DC motors which can produce maximum torque when they are activated. The rotating directions of these motors are reversed by changing polarities of a DC current to be supplied, so that the movable racks move forward or backward in accordance with rotating directions of the wheels. Further, the electric motors generates a permanent magnetic field using permanent magnets. Each movable rack is provided with a pair of direction switches at leading and trailing edges thereof, i.e. on a side panel on the side surface thereof. Specifically, the movable rack 1 has direction switches 11 and 12; the movable rack 2 has direction switches 21 and 22; the movable rack 3 has direction switches 31, 32; and the movable rack 4 has direction switches 41 and 42; and the movable rack 4 has direction switches 51 and 52.

Each movable rack is provided with an actuating circuit which supplies power to each electric motor and turns it when one of the direction switches is operated. For example, when the direction switch 11, 21, 31, 41 or 51 is operated, DC power is supplied in order to turn the electric motor 13, 23, 33, 43 or 53 in a first direction. Further, when the direction switch 12, 22, 32, 42 or 52 is operated, the DC power is supplied in order to turn the electric motor 13, 23, 33, 43 or 53 in a second direction opposite to the first direction.

The electric motors 13, 23, 33, 43 and 53 include clutches, or clutches are provided in power transmission mechanisms between these motors and the wheels 14, 24, 34, 44 and 54. The clutches are connected to electric motors which are in operation, and transmit rotary force of the motors to the wheels. Otherwise, the clutches are disconnected from the electric motors which remain inactive. Alternately, the clutches may be electromagnetic clutches which are activated when the electric motors are turned on, or centrifugal clutches which are connected by the centrifugal force when the electric motors are activated and turned.

Referring to FIG. 1, when the left direction switch 31 is pushed to the right on the movable rack 3, its electric motor 33 turns in one direction, which enables the movable rack 3 to be moved to the right. As a result, a work space is formed between the movable racks 2 and 3. In this case, only the electric motor 33 of the movable rack 3 is activated and is connected to the clutch of the movable rack 3, so that the rotary force of the electric motor 33 is transmitted to the wheels 34. In this state, no power is supplied to the electric motors of the movable racks except for the movable rack 3, so that the clutches of those motors remain disconnected. The other movable racks can be moved with relatively small force since their wheels have a reduced rotation resistance. Therefore, the movement of the movable rack 3 in response to the activation of the electric motor 33 allows the movable racks 4 and 5 to move to the right.

Figure 2:
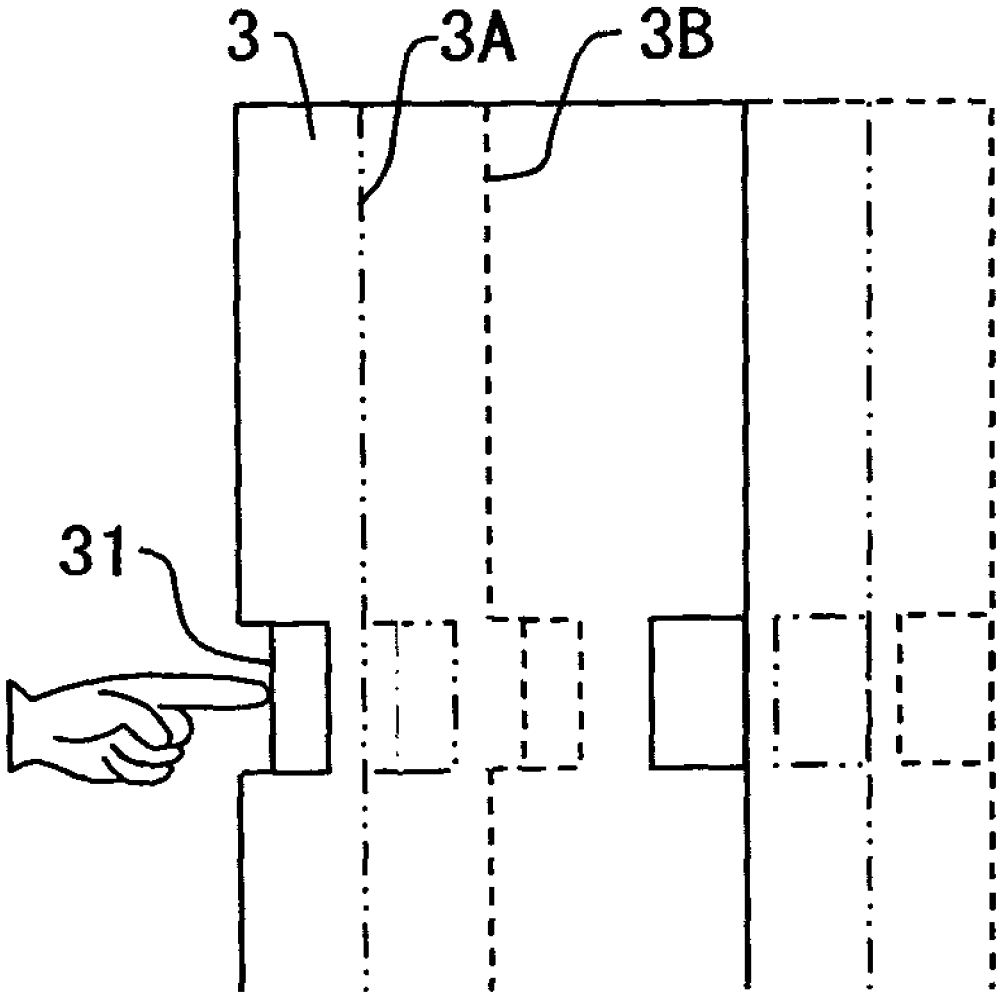
FIG. 2 is a side elevation showing how one of movable racks is moved when a direction switch is operated thereon.

The movable rack 3 keeps on moving while the direction switch 31 is being pushed. Referring to FIG. 2, the movable rack 3 is moved to the right as shown by a chain line 3A and a dashed line 3B. When an operator considers that there is a sufficient work space between the movable racks 2 and 3, he or she releases the direction switch 31 in order to stop the movable rack 3. As a result, the movable racks 4 and 5 moved together with the movable rack 3 are also stopped.

If the right direction switch 32 of the movable rack 3 is pushed to the left, the movable rack 3 is moved leftward. The movable rack 3 stops when the direction switch 32 is released. The foregoing operations are applied to all of the movable racks. In other words, when each left direction switch is pushed to the right, each movable rack is moved to the right. On the other hand, when each right direction switch is pushed to the left, each movable rack is moved to the left. As soon as each switch is released, each movable rack is stopped at its current position.

In the example shown in FIG. 1, the five movable racks can be gathered as one group, and can be individually moved in order to form a work space between desired movable racks. Sometimes, the outermost movable rack 1 or 5 has to move other movable racks which are disconnected from their clutches. Therefore, the electric motor of each movable rack is required to have torque enough to move movable racks that are disconnected from their clutches.

Electric motors of existing movable racks are usually AC motors having low running torque, so that the electric motors of all the movable racks to be moved are simultaneously activated in order to compensate for the low torque.

According to the invention, the electric motor of only one movable rack is activated in order to push other movable racks. This can simplify the circuit configuration. The electric motors should have large torque, i.e. running torque, so that DC motors having large running torque are used in the invention.

The outermost movable racks are often required to move many movable racks while the intermediate movable rack pushes a relatively reduced number of movable racks. As a result, the electric motors of the outermost movable racks may have relatively large torque while the electric motors of inner movable racks may have relatively small torque.

In this embodiment, the movable racks include the direction switches on their opposite side edges. The right or left direction switches are selectively operated in order to move movable racks to the right or left as if the operator manually moves the movable racks by himself or herself. The movable racks are actually moved by the assistance of the electric motors, so that heavy movable racks can be moved easily and smoothly.

Only during the depression of the direction switches, power is supplied to the electric motors in order to move the movable racks. When the direction switches are released, the movable racks are stopped. The movable racks are selectively moved to the right or left depending upon which left or right direction switches are operated by the operator. In other words, the movable racks are moved in a desired direction under control of the operator. Therefore, it is possible to dispense with various detection circuits which are necessary in existing power-driven movable racks in order to check the following items: a position of an existing work space; a position of a new work space to be formed; and a direction to move movable racks on the basis of the existing work space and the new work space. Further, it is possible to dispense with control circuits which are operated in accordance with data obtained by the foregoing detection circuits. As a result, the present invention can provide the power-assisted movable racks which have the simple circuit configuration and are less expensive.

The power-assisted movable racks are operated under operator's control. When an operator is aware that someone is present in an existing work space, he or she never moves movable racks in a direction where the existing work space will be narrowed. However, an operator who is unaware of someone behind a movable rack may move movable racks and narrow the existing work space. In such a case, the movable racks are stopped by inactivating the electric motors.

Figure 3:
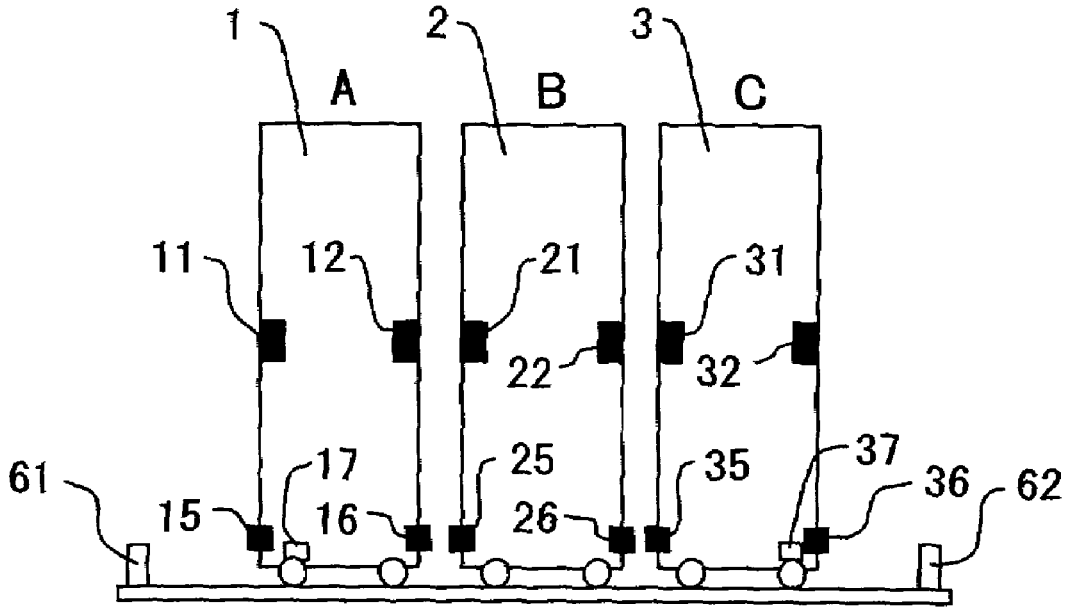
FIG. 3 is a side elevation schematically showing the concept of safety bars and buffers provided in the power-assisted movable rack system.

Referring to FIG. 3, a safety device will be described with respect to the movable racks 1, 2 and 3, for example, in order to simplify the description. The safety device includes safety bars 15, 16, 25, 26, 35 and 36, which are positioned on the front and rear surfaces of the movable racks 1, 2 and 3, and come into contact with operators or other articles. Specifically, the movable rack 1 has the safety bars 15 and 16; the movable rack 2 has safety bars 25 and 26; and the movable rack 3 has safety bars 35 and 36. Each safety bar laterally extends substantially along the width of each movable rack, and has a safety bar switch which is activated when something or the operator comes into contact therewith. The safety bars may be attached using any material, e.g. they may be laterally supported using a front panel, support pillars or the like. When any safety bar switch is activated, power supplied to the electric motors will be immediately suspended. As shown in FIG. 3, the safety bars are near the bottoms of the movable racks. Alternatively, they may be present at higher positions of the movable racks, or both at the bottoms and higher positions of the movable racks.

In the movable rack system, the movable racks can be moved in predetermined distances. In the example of FIG. 3, end stops 61 and 62 are used in order to regulate moving distances of the movable racks 1 and 3. When coming into contact with the end stop 61, the movable rack 1 is kept from moving further to the left. The end stop 62 prevents the movable rack 3 from moving further to the right. However, if the movable rack 1 or 3 is directly stopped by the end stop 61 or 62, articles stored therein may become loose or fall down. In order to overcome this problem, a buffer 17 is provided near the left side edge of the leftmost movable rack 1 in order to cooperate with the end stop 61 while a buffer 37 is provided near the right side edge of the rightmost movable rack 3 in order to cooperate with the end stop 62. The buffers 17 and 37 alleviate shocks applied to the movable racks 1 and 3 when they strike against the end stops 61 and 62, and also suspend the power supplied to the electric motors and protect them against overload even if the direction switches are left operated.

Figure 4:
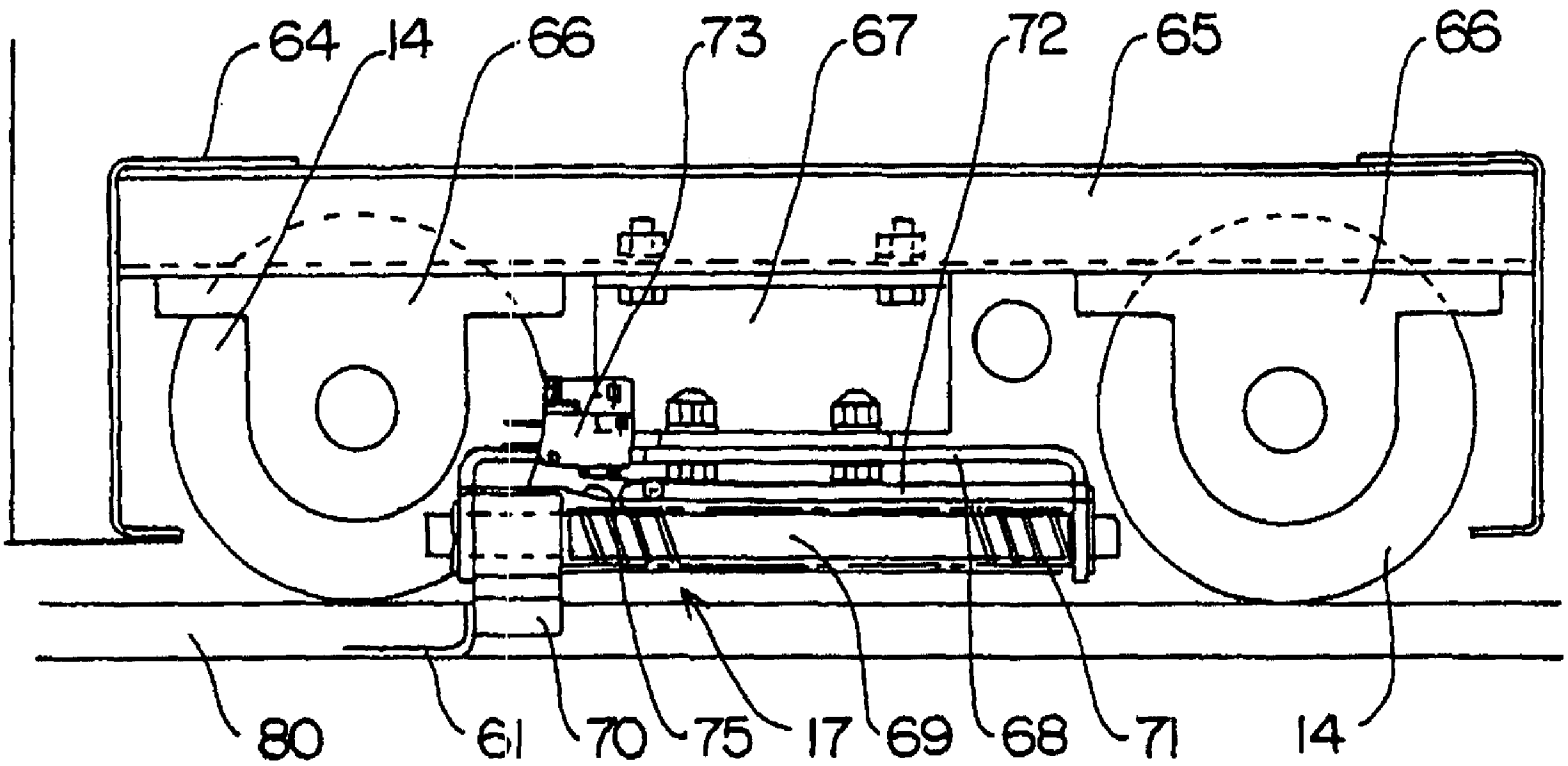
FIG. 4 is a side elevation of an example of the buffers.
Figure 5:
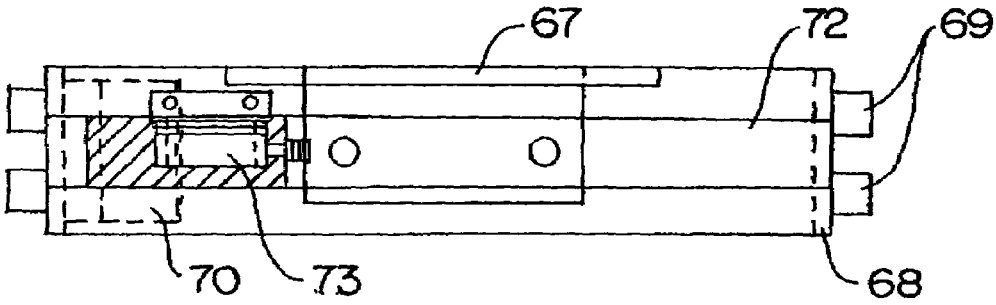
FIG. 5 is a top plan view of the buffer.
Figure 6:
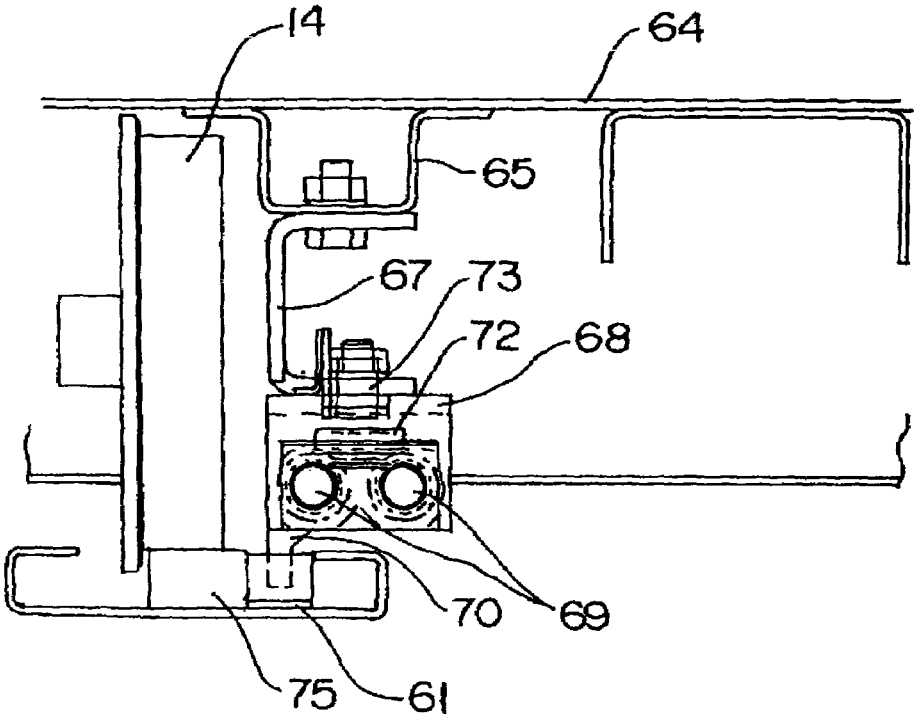
FIG. 6 is a front elevation of the buffer.

The buffer 17 will be described with reference to FIG. 4 to FIG. 6. Each movable rack is mounted on an under-frame 64. Alternatively, articles may be directly loaded on the under-frame 64. A plurality of steel beams 65 in the shape of an E-channel are fixedly attached on an inner ceiling of the under-frame 64 by welding or the like. The beams 65 extend in the moving direction of the movable rack, and are appropriately spaced when viewed in the direction of the frontage of the movable rack. The front and rear wheels 14 are rotatably attached to the bottom of the beams 65 via pillow blocks 66. The front and rear wheels 14 are placed and turn on rails 80, which enables the movable rack to move on the rails 80. The front or rear wheels 14 are activated and turned by the electric motor.

An L-shaped angle member 67 is attached on the bottom of the beams 65 and between the front and rear wheels 14 with spaces maintained therebetween. A bearing 68 in the shape of an inverted U is attached to an underside of the angle member 67, and extends along the length of the beam 65. Two shafts 69 are fixedly attached via holes in front and rear downward pieces, and are parallel to each other. A contact member 70 associated with the end stop 61 is fitted on outer surfaces of the shafts 69, extends over the shafts 69, and is slidable on the shafts 69. The contact member 70 has a part of its lower part extending downward, which comes into contact with the end stop 61. The end stop 61 is made of an angle member in the shape of letter L, and includes horizontal pieces fixedly attached on the floor and vertical pieces extending upward from the horizontal pieces. The vertical pieces come into contact with the contact member 70.

A compressed coil spring 71 is fitted around the two shafts 69. A resiliency of the compressed coil spring 71 acts between the right vertical piece of the bearing 68 and the contact member 70, urges the contact member 70 to the left. The contact member 70 comes into contact with the left vertical piece of the bearing 68, thereby preventing the contact member 70 from being moved by the resiliency of the coil spring 71. Referring to FIG. 4, when the movable rack 1 is moved to the left, the contact member 70 comes into contact with the end stop 61, and is moved to the right while compressing the coil spring 71. As a result, force for returning the coil spring 71 is stored.

The bearing 68 includes an end switch 73, and the contact member 70 has an end switch actuator 72 on its top. The end switch 73 has a tip of its operation lever placed on the end switch actuator 72. The end switch actuator 72 extends in a sliding direction of the contact member 70, and has a sloped part 75 at the center thereof. The end switch actuator 72 has different heights at the opposite sides of the sloped part 75. Normally, the contact member 72 is in contact with the left vertical piece by the resiliency of the coil spring 71, and the tip of the operation lever of the end switch 73 is present on a lower side of the end switch actuator 72, so that the end switch 73 does not operate.

The contact member 70 comes into contact with the end stop 61 and moves to the right (see FIG. 4) against the resiliency of the coil spring 71. In this state, the contact member 70 and the end switch actuator 72 are moved to the right, so that the sloped part 75 of the end switch actuator 72 pushes the tip of the operation lever upward. As a result, the end switch 73 will be activated, and power supplied to the DC motor of the movable rack will be suspended.

The buffer 17 is effective in the following respect: when the movable rack 1 is moved to its limit, the contact member 70 strikes against the end stop 61, and is urged to move against the resiliency of the coil spring 71, so that shocks applied by the movable rack 1 stopped by the end stop 61 is absorbed by the coil spring 71, and the articles stored on the movable rack 1 are prevented from becoming loose or falling down. The coil spring 71 absorbs the shocks, is compressed, and urges the movable rack 1 backward using the force stored therein. In this state, the end switch 73 is released. The power will be re-supplied to the electric motors by operating one of the direction switches on the movable racks.

The buffer 37 shown in FIG. 3 is identical to the buffer 17 although their orientations are reverse.

Figure 9:
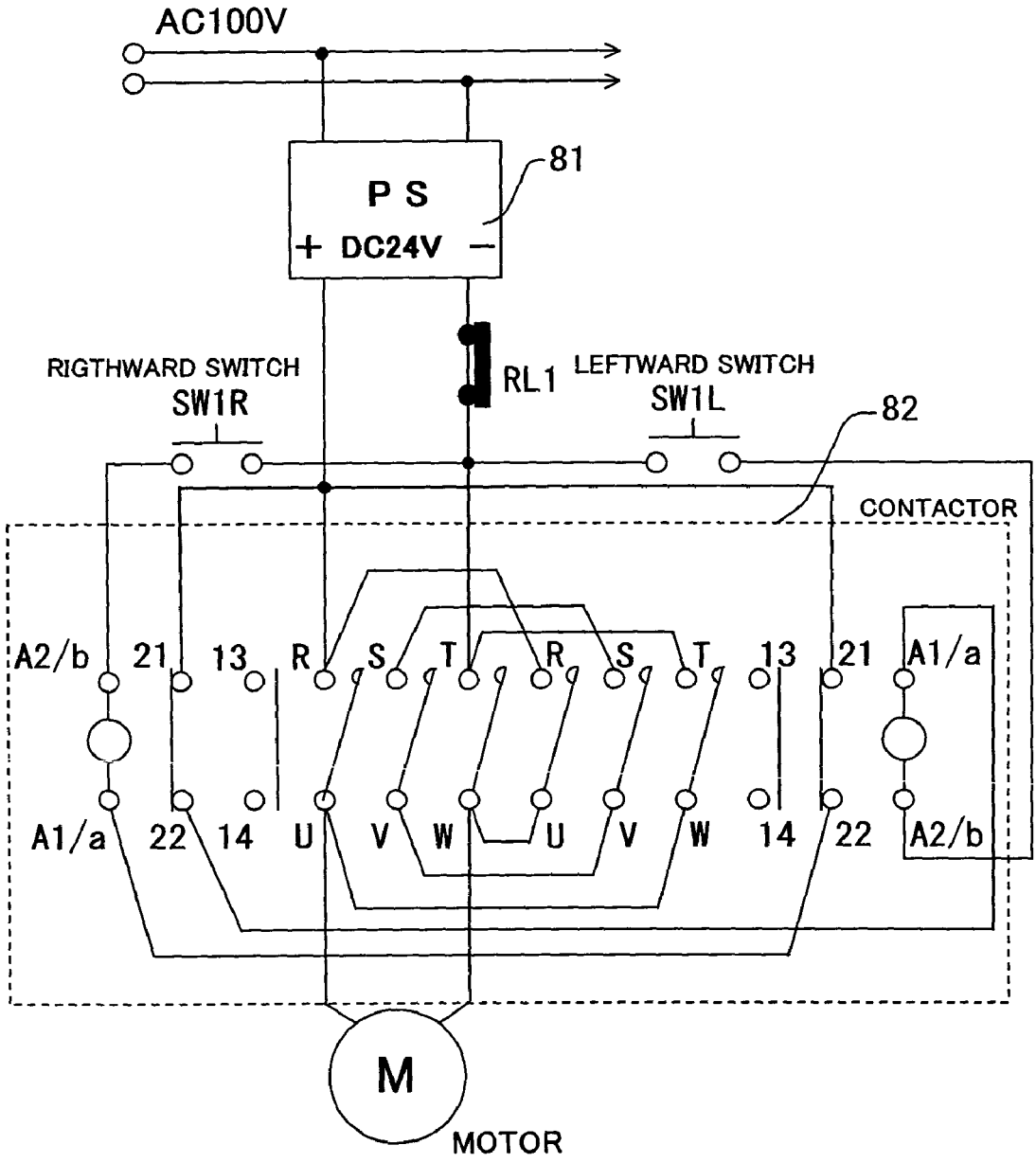
FIG. 9 shows an example of a circuit applicable to the invention.

An electric circuit applicable to the foregoing embodiment will be described with reference to FIG. 9 to FIG. 12. FIG. 9 shows a power supply circuit for an electric motor of one of the movable racks. In this drawing, reference number 81 denotes a DC stabilizing power supply for converting AC power to DC power, and reference number 82 denotes a contactor for selecting a contact to be conducted by changing a polarity of the supplied DC power. A rightward switch SW1R relates to the left direction switch of each movable rack, and a leftward switch SW1L relates to the right direction switch of each movable rack, as shown in FIG. 1.

Referring to FIG. 9, the contactor 82 includes a plurality of contacts which are operated when the DC power is supplied in one direction, and a plurality of contact which are operated when the DC power is supplied in the reverse direction. These contacts are symmetrical. When the rightward switch SW1R is turned on, the DC is supplied from the positive pole of the DC stabilizing power supply 81 via right contacts 21, 22 and left contacts A1/*a*, A2/*b* of the contactor 82, rightward switch SW1R, a break contact of a relay RL1, and the negative pole of the DC stabilizing power supply 81. Specifically, the contacts at the left half in FIG. 9 are activated. Thereafter, the DC power is supplied from the positive pole of the DC stabilizing power supply 81 via left contacts R and U of the contactor 82, a motor M, contacts W and T, a break contact of the relay RL1, and the negative pole of the DC stabilizing power supply 81. As a result, the motor M is turned in one direction (i.e. forward in this example), so that the movable rack is moved to the right (in FIG. 1).

When the leftward switch SW1L is turned on, the DC power is supplied from the positive pole of the DC stabilizing power supply 81 via left contacts 21, 22 and left contacts A1/*a*, A2/*b* of the contactor 82, the leftward switch SW1R, the break contact of the relay RL1, and the negative pole of the DC stabilizing power supply 81. Specifically, the contacts at the right half in FIG. 9 are activated. Thereafter, the DC power is supplied from the positive pole of the DC stabilizing power supply 81 via right contacts R and U of the contactor 82, the motor M, contacts W and T, a break contact of the relay RL1, and the negative pole of the DC stabilizing power supply 81. As a result, the motor M is turned in the reverse direction, so that the movable rack is moved to the left.

Regardless of the moving direction, right or left, of the movable rack, the DC power supplied to the contactor 82 is suspended by releasing the direction switch of the movable rack and turns off either the switch SW1R or SW1L, so that the contacts of the contactor 82 to supply the DC power to the motor M will be moved to the neutral position. Therefore, the motor M will be stopped, and the movable rack becomes stationary.

Figure 10:
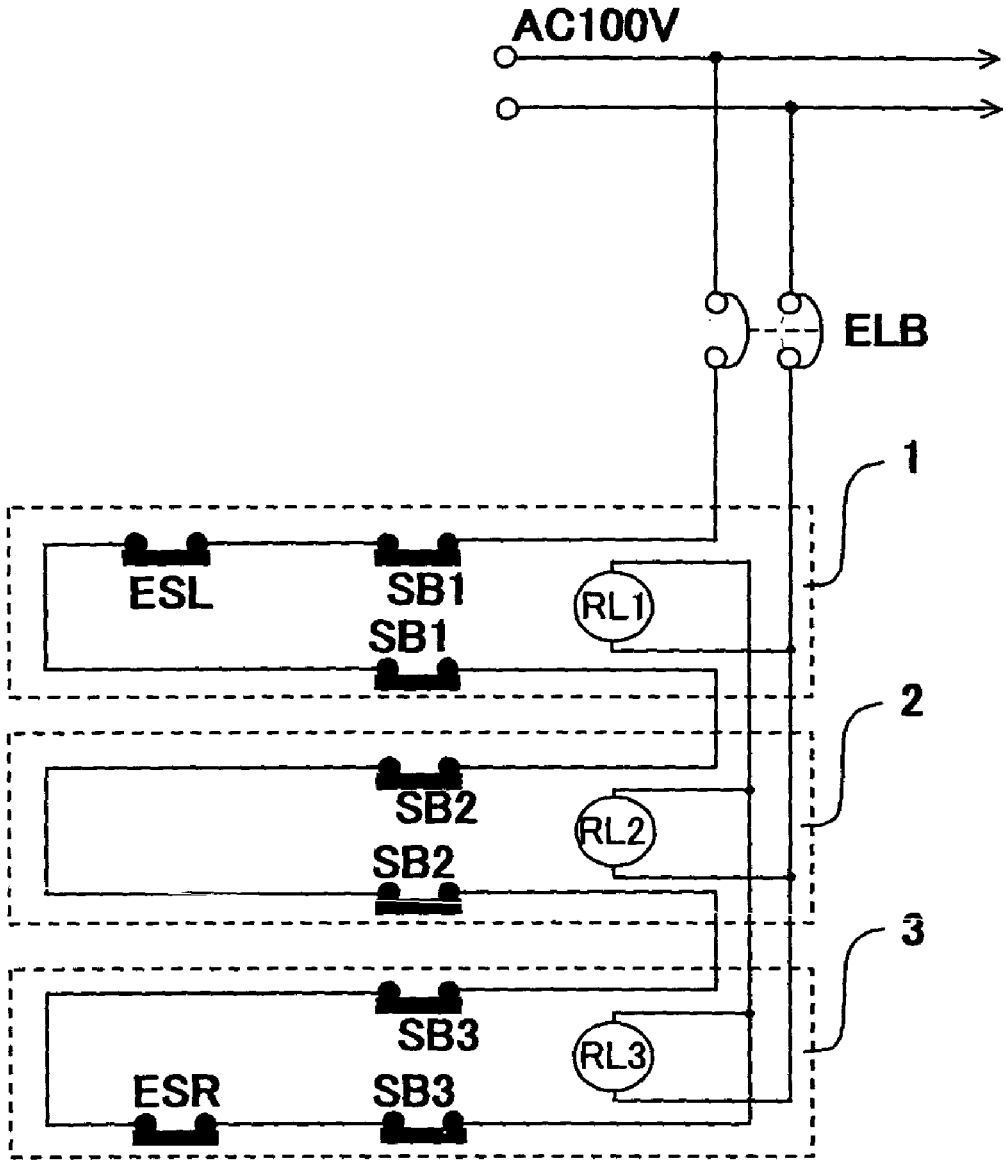
FIG. 10 shows a circuit of a safety device which is applicable to the invention and includes safety bars and buffers.
Figure 11:
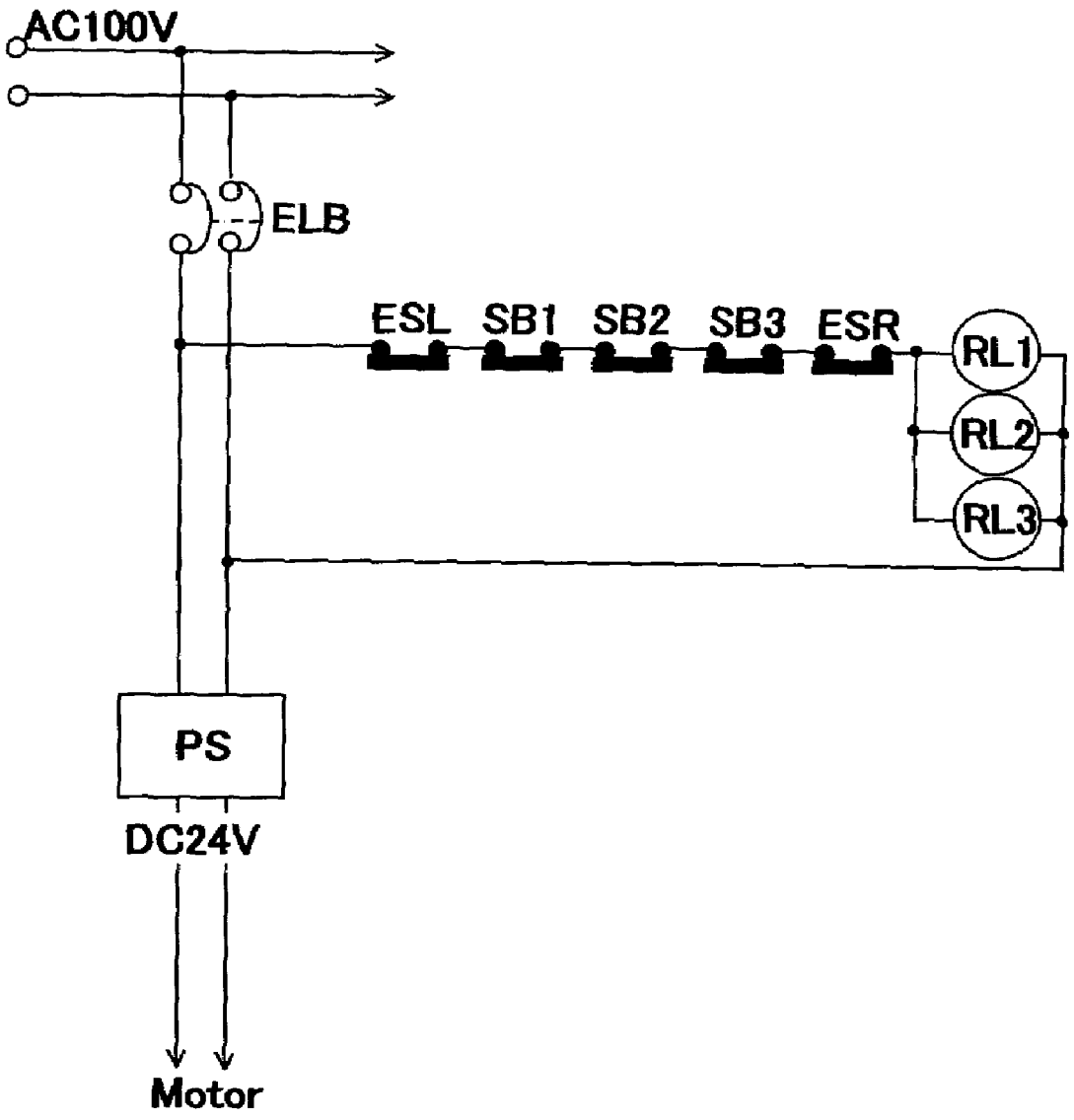
FIG. 11 is a circuit diagram of the safety device, depicted in a simplified manner.

FIGS. 10 and 11 show the relationship between the safety bars and the end switches shown in FIG. 3. In these figures, ELB denotes an earth leakage breaker, PS denotes a DC stabilizing power supply, ESL denotes a left end switch, ESR denotes a right end switch, SB1, SB2, and SB3 denote safety bar switches of the movable racks 1, 2 and 3, and RL1, RL2 and RL3 denote relays of the movable racks 1, 2 and 3. These switches have break contacts. The relays RL1, RL2 and RL3 are connected in parallel, while the switches ESL, SB1, SB2, SB3 and ESR are connected in series. Therefore, the relays are continuously energized, and will be de-energized when any one of the foregoing switches is turned on and then turned off.

Figure 12:
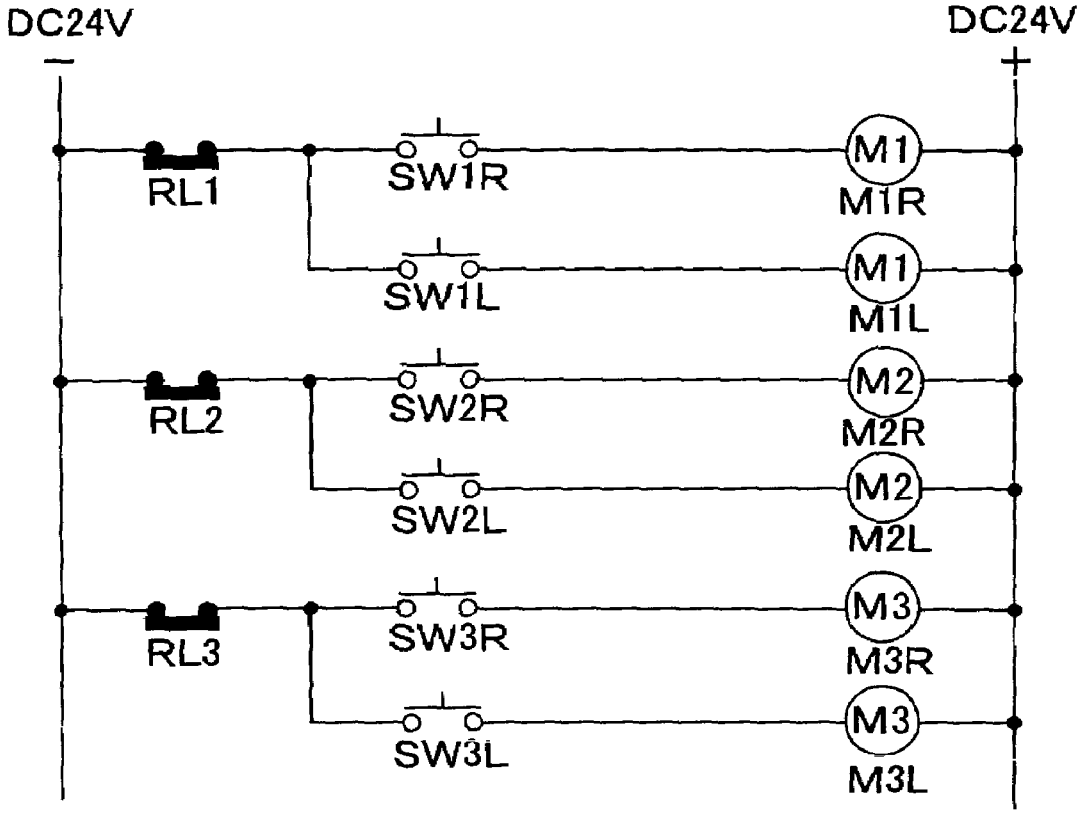
FIG. 12 shows a circuit for selectively moving movable racks forward or backward.

FIG. 12 equivalently shows circuits for introducing power to the electric motors of the respective movable racks. The contactors of the movable racks include electromagnets M1L, M1R, M2L, M2R, M3L and M3R. Letters L and R in these reference numerals denote the directions of the DC power because it is supplied in the forward and backward directions. For example, in the movable rack 1, the contact of the relay RL1, the leftward switch SW1L and the electromagnet M1R which are connected in series are connected to the DC power supply, and the rightward switch SW1R and the electromagnet M1L which are connected in series are connected to the DC power supply. In the movable rack 2, the contact of the relay RL2, the leftward switch SW2L and the electromagnet M2R which are connected in series are connected to the DC power supply, and the rightward switch SW2R, the leftward switch SW2L and the electromagnet M2L which are connected in series are connected to the DC power supply. The same holds true to the movable rack 3.

As described with respect to FIGS. 10 and 11, when any of safety bar switches or the end switches is actuated, the relays RL1, RL2 and RL3 will be de-energized, so that the contacts of the relays shown in FIG. 12 will be opened. As result, power supplied to the movable rack where either right or left direction switch is turned on will be suspended, so that no power is supplied to the electric motor, thereby stopping the movable rack. The DC power supplied to the contactor 82 shown in FIG. 9 is suspended, the contacts of the contactor 82 are opened, the electric motor will not receive any DC power, and the movable rack will be stopped.

According to the invention, the power-assisted movable racks has the simplified circuit configuration which enables the operator to control the movement of the movable racks as desired. Even if the operator is unaware of the presence of a person in an existing work space and happens to move movable racks to narrow the work space, the safety bar switches will be operated in order to suspend power supply to the movable racks and stop them. Further, when detecting that a movable racks strikes against the end stop, the end switch suspends power supply to the movable rack and stops it. The safety bar switches and the end switches are preferably connected in series. Even when these switches are provided, the circuit configuration of the movable racks of the present invention is simplified compared with that of the movable racks of the related art.

In the foregoing embodiment, the clutches are provided between the wheels and electric motors of the movable racks, and remain disconnected so long as the electric motors are not activated. However, the clutches are not always indispensable for the following reasons. According to the invention, the power-assisted movable rack system employs the DC motors as the driving force supply. Having large running torque, the DC motors can have a small speed reduction ratio, which means that the rotational force of the wheels is transmitted to the DC motors with a relatively small resistance. Even if no clutch is provided between the wheels and the DC motors, only a relatively small load is required to move a plurality of movable racks via one movable rack. Therefore, the clutches may be dispensable. Further, the wheels may turn on the rails in response to an earthquake even when no clutches are provided. No earthquake energy will be transmitted to the movable racks, which is effective in protecting the movable racks against vibrations.

Needless to say, the clutches which are connected to the electric motors and wheels only during the activation of the electric motors enable a plurality of movable racks to be smoothly moved by one movable rack. Further, the clutches are advantageous in protecting the movable racks against earthquakes.

The small speed reduction ratio realized by using the DC motors is effective in moving the movable racks at high speeds, which enables quick formation of a work space and improves the work efficiency of the movable rack system.

In the embodiment shown in FIGS. 1 to 3, the work space may be also formed between two movable racks facing with each other by simultaneously moving them. For instance, it is assumed that a work space is to be formed between the movable racks 2 and 3. The right direction switch 22 of the movable rack 2 is pushed to the left while the left direction switch 31 of the movable rack 3 is pushed to the right, so that the movable racks 2 and 3 moved to the left and right, respectively. Needless to say, the remaining movable racks may be also moved in this state. The work space can be quickly formed by simultaneously moving movable racks at the opposite side thereof because of the accelerated movement of the movable racks enabled by the DC motors. A 900 mm to 1,000 mm work space can be formed in approximately four seconds.

However, if two movable racks are simultaneously moved to the left and right, respectively, one of them may have a reduced margin to move, and make its buffer strike against the end stop. The following describe the case in which the buffer 17 comes into contact with the end stop 61 shown in FIGS. 4 to 6. In the buffer 17, the contact member 70 strikes against the end stop 61, and slides along the shaft 69 while compressing the coil spring 71. The end switch actuator 72 moves with the contact member 70, and the sloped part of the end switch actuator 72 pushes the operation lever of the end switch 73, thereby operating the end switch 73. Therefore, the motor activating circuits of all the movable racks will be released, thereby preventing the motor of the movable rack striking against the end stop from being overloaded.

If the end switch remains active in the foregoing state, no power will be supplied to the DC motors, and no movable racks can be moved. However, the movable rack 1 striking the end stop is pushed back by the compressed coil spring, which returns the end switch to its original state. As a result, the movable rack 1 can resume its movement. With the buffers shown in FIGS. 4 to 6, the contact member 70 is pushed back by the force stored in the coil spring 71, and presses the end stop 61, so that the movable rack 1 is moved to the right as shown in FIG. 4. Further, the operation lever of the end switch 73 slides down on the sloped part 75 of the end switch actuator 72, thereby turning the end switch 73 off. Thereafter, power can be supplied to the electric motors of the movable racks, which enables the movable racks to be moved by operating the direction switches.

Figure 7:
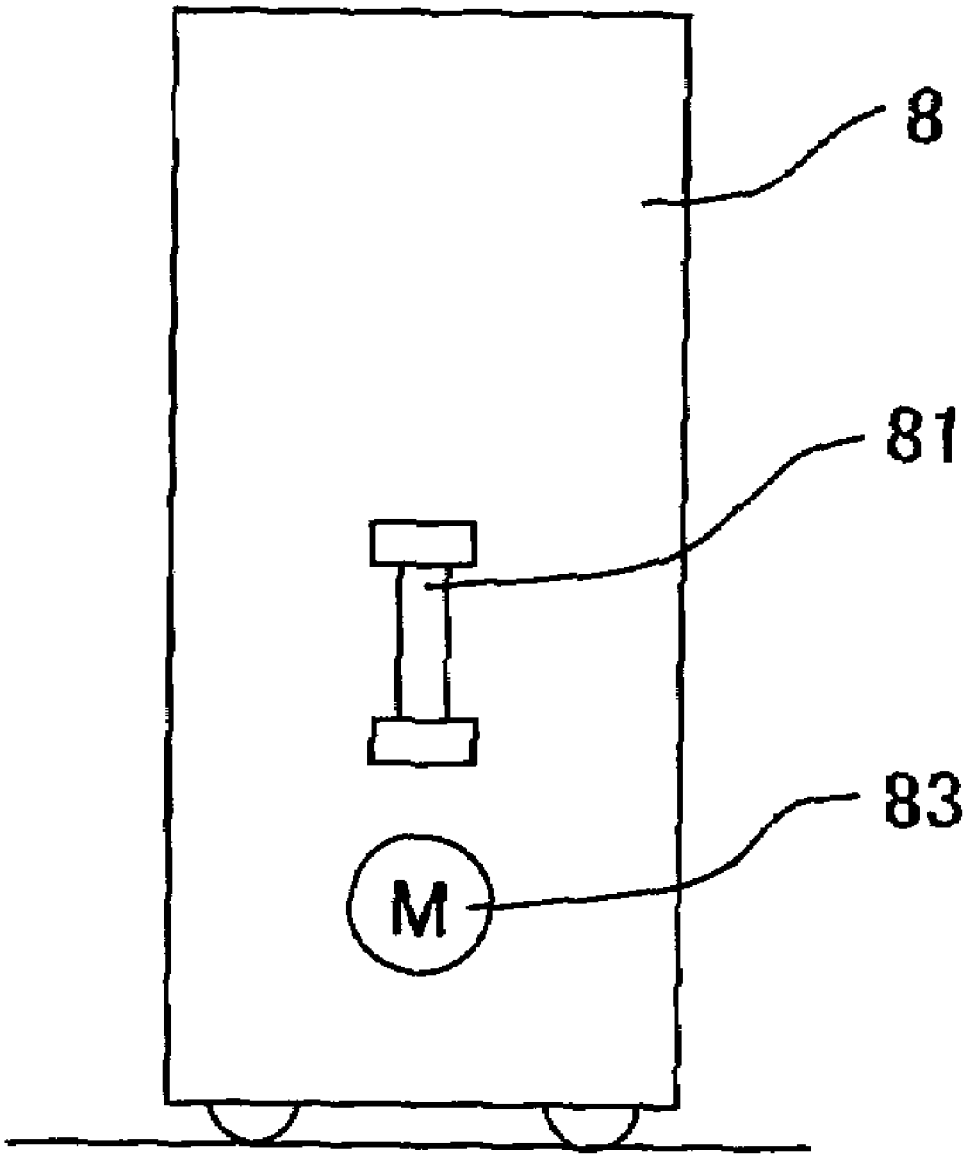
FIG. 7 shows an external appearance of a power-assisted movable rack in a second embodiment of the invention.

In the example shown in FIGS. 1 to 3, the movable racks can be moved to the right or left by operating the left or right direction switch to a desired direction in which a movable rack is to be moved. Alternatively, as shown in FIG. 7, a movable rack 8 is provided with a grip 81 at the center of its side surface, and is moved in a desired direction by pulling the grip 81 to the right or left. When the grip 81 is pulled to the right, a rightward switch (not shown but corresponding to the switch SW1R shown in FIG. 9) is turned on, and a DC motor 83 of the movable rack 8 is rotated forward in order to move the movable rack 8 to the right. Conversely, when the grip 81 is pulled to the left, a leftward switch (not shown but corresponding to the switch SW1L shown in FIG. 9) is turned on, and the DC motor 83 of the movable rack 8 is rotated in the reverse direction in order to move the movable rack 8 to the left.

With this structure, the movable rack 8 can be smoothly moved under assistance of the electric motor 83, so that the operator may feel as if he or she actually moves them by himself or herself by pulling the grip 81. In this case, the end stops and the circuit configuration may be identical to those in the foregoing example. This structure is as advantageous and effective in the foregoing example.

Figure 8:
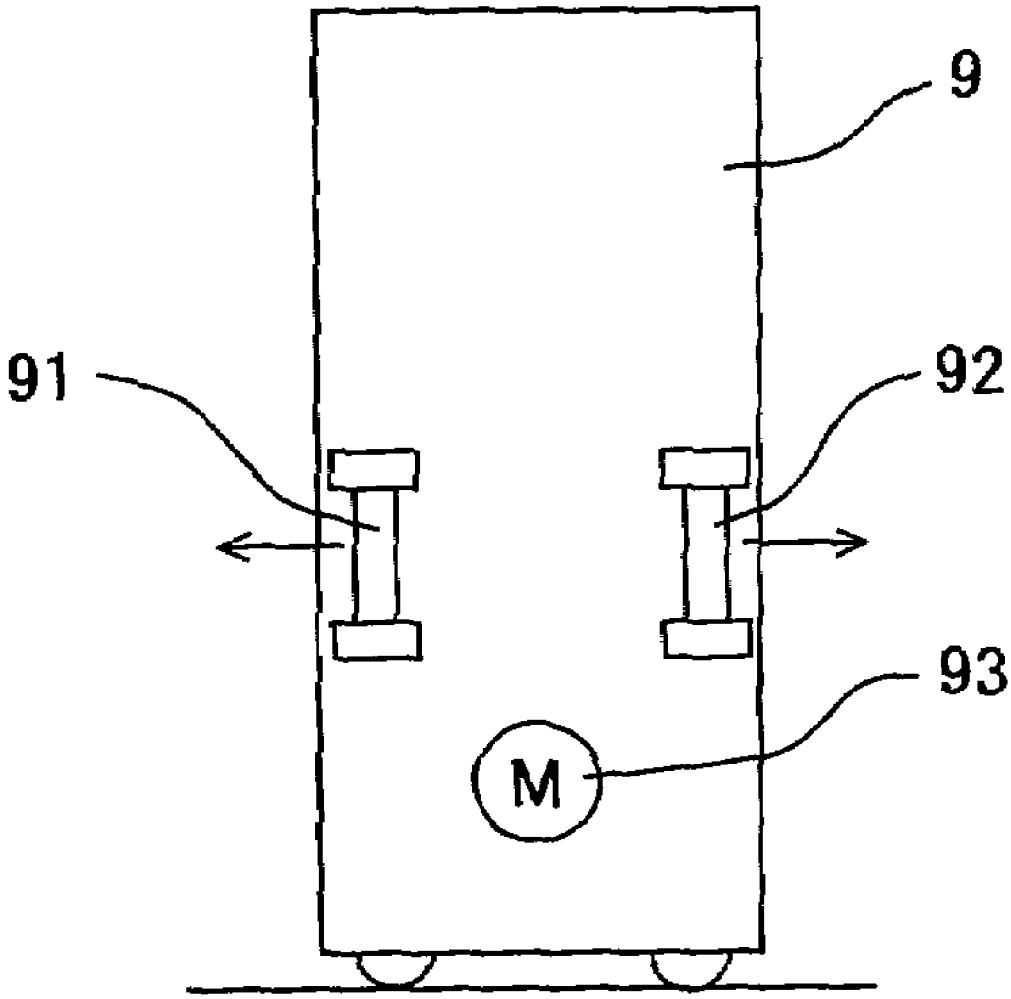
FIG. 8 shows an external appearance of a power-assisted movable rack in a third embodiment of the invention.

Referring to FIG. 8, right and left grips 91 and 92 are provided near the opposite side edges of a movable rack 9 in order to move it in a desired direction. Specifically, when the grip 91 is pulled in order to move the movable rack 9 to the left, a switch corresponding to the switch SW1L (shown in FIG. 9) is turned on, and an electric motor 93 of the movable rack 9 is rotated in one direction, thereby moving the movable rack 9 to the left. Conversely, when the grip 92 is pulled in order to move the movable rack 9 to the right, a switch corresponding to the switch SW1R (shown in FIG. 9) is turned on, and the electric motor 93 of the movable rack 9 is rotated in the reverse direction, thereby moving the movable rack 9 to the right.

With this structure, the movable racks can be smoothly moved by the assistance of the electric motor 83, so that the operator may feel as if he or she actually moves them by himself or herself by pulling the grip 91 or 92. In this case, the end stops and the circuit configuration may be identical to those in the foregoing example. This structure is as advantageous and effective in the foregoing example.

The invention will be described with reference to a second embodiment using a modified control circuit shown in FIG. 13. This control circuit includes left direction switches which correspond to the left direction switches 11, 21, 31, 41 and 51 shown in FIG. 1, and right direction switches which correspond to the right direction switches 12, 22, 32, 42 and 52 shown in FIG. 1.

Figure 13:
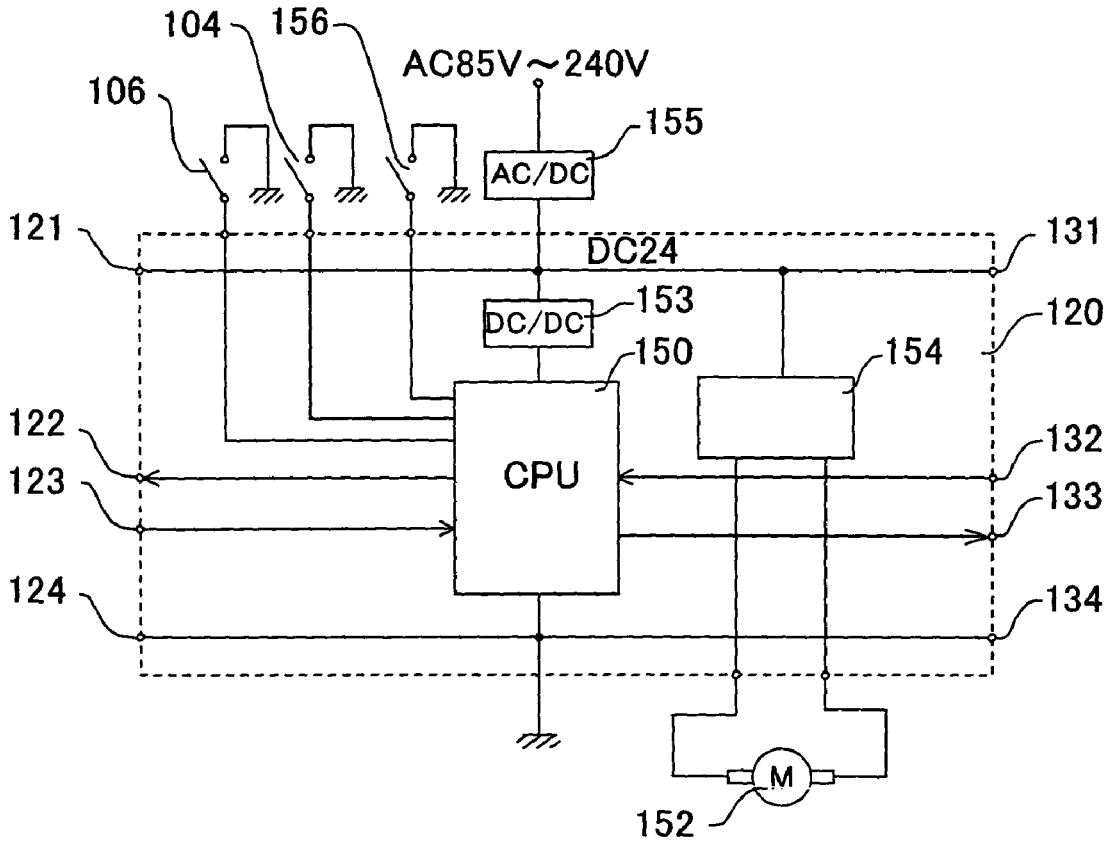
FIG. 13 shows a further control circuit applicable to the invention.

In FIG. 13, reference numeral 120 denotes a circuit board incorporated in each movable rack. A circuit board 120 of a first movable rack includes terminals 121, 122, 123 and 124 to be connected to a circuit board 120 of a second movable rack which is left to the first movable rack, and terminals 131, 132, 133 and 134 to be connected to the circuit board of the second movable rack which is right to the first movable rack. The terminal 121 is used to receive DC 24V power from an appropriate power supply and is connected to the terminal 131. The terminal 124 is a grounding terminal connected to the terminal 134. Each circuit board 120 includes a central processing unit (called the "CPU") 150, a DC-DC converter 153 and an actuating circuit 154. The actuating circuit 154 supplies DC power to and rotates a DC motor 152 forward or backward under the control of the CPU 150. The DC-DC converter 153 converts a voltage of the DC 24V power to a voltage appropriate for the CPU 150 and maintains it in a stable state. Further, the DC-DC converter 153 receives DC 24V power from an AC-DC converter 155 which converts AC power to DC power.

Each CPU 150 is connected to a right direction switch 104, a left direction switch 106, and an emergency stop switch 156. The emergency stop switch 156 may be a switch which is manually operated at the time of emergency, or may be a switch which is positioned on the frontage of each movable rack and is turned on whenever it comes into contact with an operator or something.

It is assumed here that a right direction switch 104 is turned on a (driving) movable rack and that the driving movable rack is used to move a (driven) movable rack which is adjacent to the driving movable rack. The CPU 150 of the driving movable rack controls the actuating circuit 154, drives the DC motor 152 in order to move the driving movable rack to the right and issues a rightward signal at the same time. The rightward signal is sent from the terminal 133 to a circuit board 120 of the driven movable rack, which is right to the driving movable rack, via the terminal 123. On the other hand, when a left direction switch 106 is activated on the driving movable rack, the CPU 150 of the driving movable rack controls the actuating circuit 154, actuates the DC motor 152 in order move the driving movable rack to the left, and issues a leftward signal at the same time. The leftward signal is sent from the terminal 122 via the terminal 132 to the circuit board 120 of the driven movable rack which is left to the driving movable rack.

When receiving a leftward signal from the driving movable rack via the terminal 132, the CPU 150 of the driven movable rack controls the actuating circuit 154, actuates the electric motor 152 in order to move the driven movable rack to the left, and issues and transmits the leftward signal to another driven movable rack which left to the driven movable rack, via the terminal 122. Conversely, when receiving a rightward signal from the driving movable rack via the terminal 123, the CPU 150 controls the actuating circuit 154, actuates the electric motor 152 in order to move the driven movable rack to the right, and issues and transmits the rightward signal to the driven movable rack which is right to the driven movable rack, via the terminal 133.

Further, the CPU 150 controls the actuating circuit 154 in order to operate the DC motor 152 of the driving movable rack, where the right or left direction switch 104 or 106 is operated, at a rated output.

When receiving the rightward or leftward signal from the driving movable rack, the CPU 150 of the driven movable rack controls the actuating circuit 154 so that the actuating circuit 154 provides the DC motor 152 of the driven movable rack with power which is smaller than that supplied to the driving movable rack (e.g. power which is barely sufficient for the driven movable rack to move by itself), or power which enables the driven movable rack to move by itself at a speed which is lower than a moving speed of the driving movable rack. The rated output of the DC motor 152 is obtained by supplying a 6A–24V current, so that the power by which the driven movable rack can move by itself can be obtained by supplying an approximately 2A–24V current.

The circuit boards in the individual movable racks are identically structured. For example, when the right direction switch 104 of a driving movable rack is operated, the rightward signal will be issued and transmitted to a driven movable racks which is right to the driving movable rack via the circuit board 120. When the left direction switch 106 of the driving movable rack is operated, the rightward signal will be issued and transmitted to a driven movable rack which is left to the driving movable rack via the circuit board 120.

Figure 14:
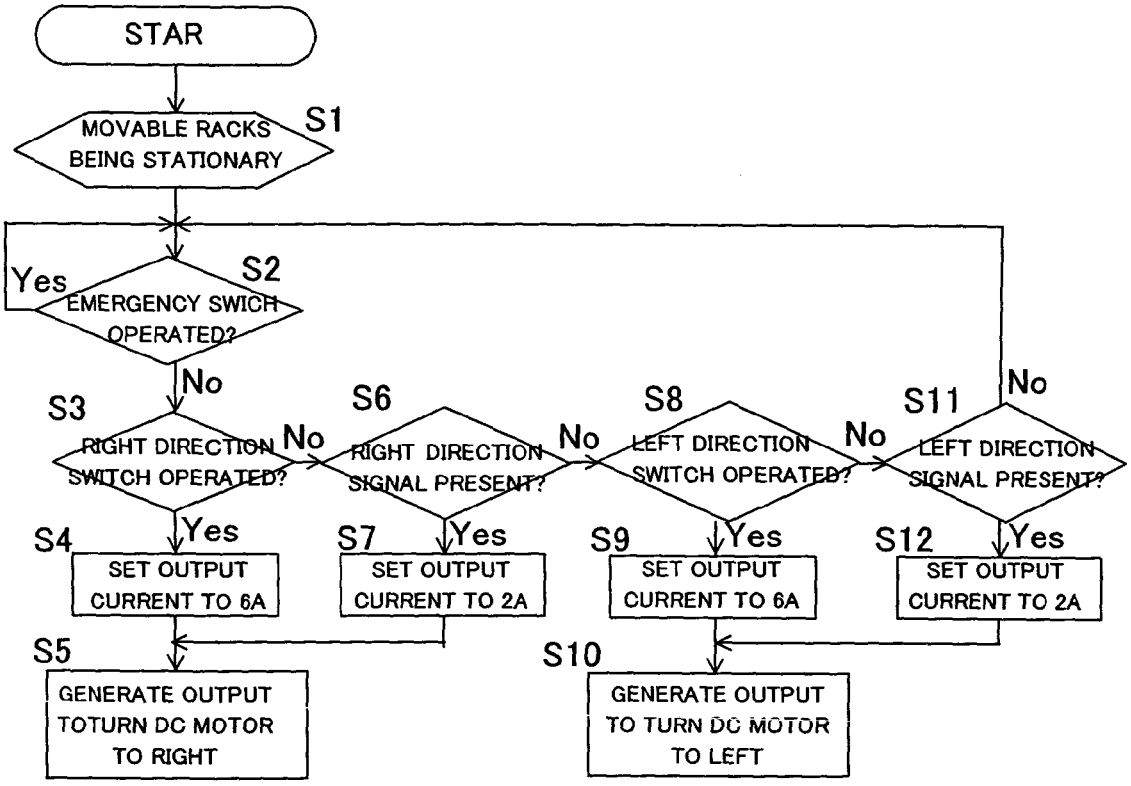
FIG. 14 is a flowchart showing the operation of the power-assisted movable rack system including the foregoing control circuit.

The operation of the second embodiment will be described with reference to a flowchart of FIG. 14. An active or inactive state of the emergency stop switch 156 is checked (step S2) while the movable racks are stationary (step S1). When the emergency stop switch 156 remains inactive, it is checked (step S3) whether or not the right switch 104 is active. If the right direction switch 104 is active, an output current is set to 6A (step S4), and the DC motor 152 is actuated at the rated output in order to move one of movable racks to the right (step S5).

If the right direction switch 104 remains inactive in step S3, it is checked (step S6) whether or not the rightward signal has been received from a driving movable rack. If so, the output current is set to 2A (step S7), and power which is not sufficient for a driven movable rack to move by itself but is enough to move the driven movable rack to the right is supplied to the electric motor 152.

When the rightward signal is absent in step S6, it is checked (step S8) whether or not the left direction switch 106 is active. When the left direction switch 106 is active, the output current is set to 6A (step S9), and the DC motor 152 is activated at the rated output in order to move the driving movable rack to the left.

If the left direction switch is not active in step S8, it is checked (step S11) whether or not the leftward signal has arrived from the driving movable rack. If the leftward signal is present, the output current is set to 2A (step S12), and power which is not sufficient for a driven movable rack to move by itself but is enough to move the driven movable rack to the right is supplied to the electric motor 152.

When no leftward signal is present in step S11, control returns to the step S2, and the foregoing steps are repeated.

A step may be added after the steps S4, S7, S8 and S12 in order to check the operation of the emergency stop switch 156 during the movement of movable racks and in order to disconnect the electric motor 152 from the power supply.

As described so far, a plurality of power-assisted movable racks are juxtaposed, and one movable rack can move other power-assisted movable racks. For example, when the rightward or leftward signal is transmitted from the driving movable rack to the driven movable rack, power which is smaller than that for moving the driving movable rack, e.g. the power which is not enough for the driven movable rack to move by itself, is supplied to the DC motor of the driven movable rack. Therefore, in order to move the driven movable rack, the driving movable rack is applied a reduced load, which enables the driving movable rack to move many driven movable racks as possible. Even when a number of movable racks have to be pushed by one movable rack, the work space having desired width can be formed as quickly as possible.

The power supplied to the DC motors of the driven movable racks is made smaller than the power supplied to the driving movable rack for the following reasons. No space may be formed between movable racks when the driven movable rack is positioned in front of the driving movable rack and is pushed forward by the driving movable rack. Therefore, the power to be supplied to the DC motor of the driven movable rack is smaller than that supplied to the driving movable rack (e.g. power which is barely sufficient for the driven movable rack to move by itself), or power which enables the driven movable rack to move by itself at a speed which is lower than a moving speed of the driving movable rack.

Usually each movable rack requires maximum energy when it is actuated. Once each movable rack starts moving, it requires reduced energy. With driven movable rack receiving the rightward or leftward signal from the driving movable rack, the DC motor receives the power which is not sufficient enough to enable the movement of the driven movable rack by itself is supplied for a short period of time before the driven movable rack starts moving.

Figure 15:
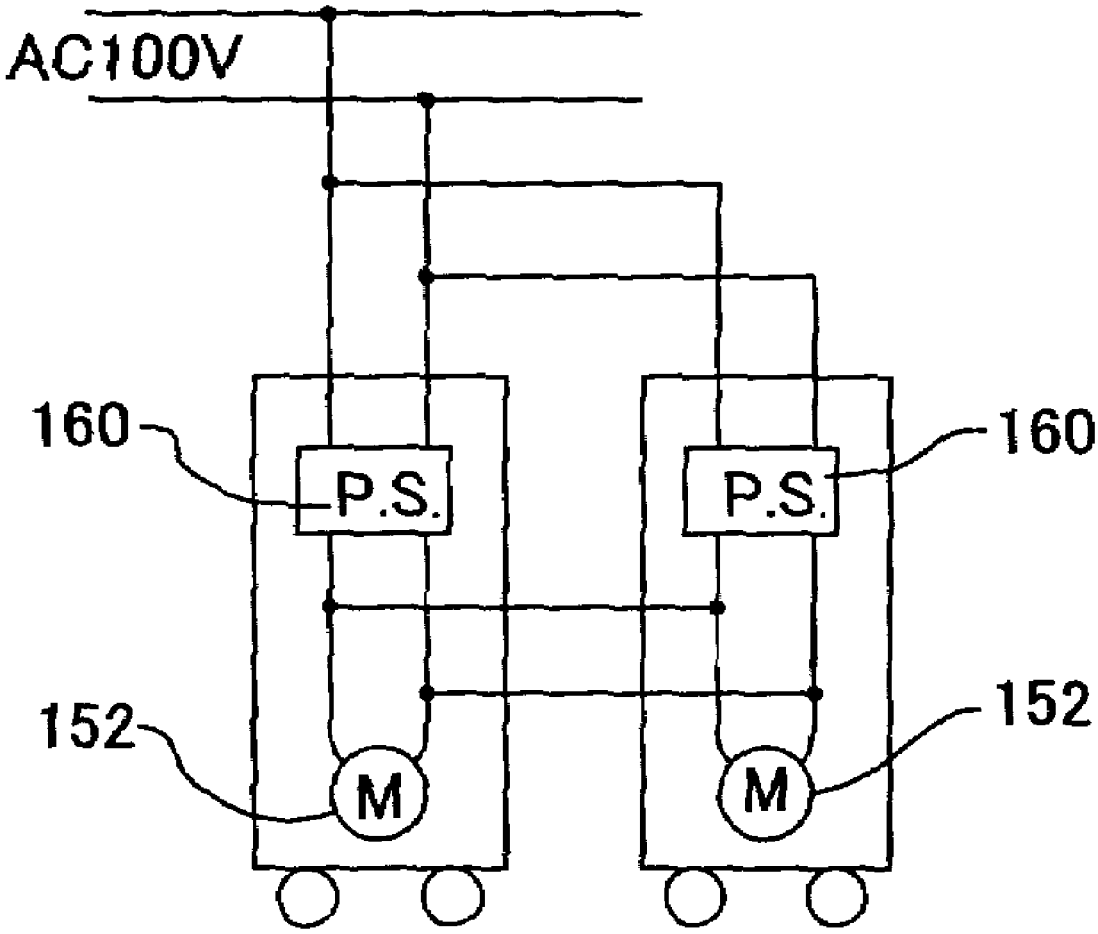
FIG. 15 shows a power supply circuit applicable to the invention.

As shown in the circuit of FIG. 15, DC power supply circuits are provided for individual movable racks, receive commercial AC power, and convert it to DC power. Further, the DC power supply circuits 160 are connected in parallel, so that the DC power supply of one movable rack may supply power to the DC motors of other movable racks.

The foregoing structure of the power-assisted movable rack system can protect the DC power supply circuit 160 of one movable rack against overload when the movable rack is used to push other movable racks. The DC power supply circuit 160 can receive power from DC power supply circuits 160 of other movable racks. Therefore, each DC power supply circuit 160 can have a small capacity, so that the circuits of the movable rack system can be made light in weight and less expensive. Further, if the DC power supply circuit 160 is provided for each block constituted by a plurality of movable racks, it should have a relatively large capacity. However, according to the foregoing embodiment, each movable rack has the small DC power supply circuit 160 which is light in weight and less expensive.

Figure 16:
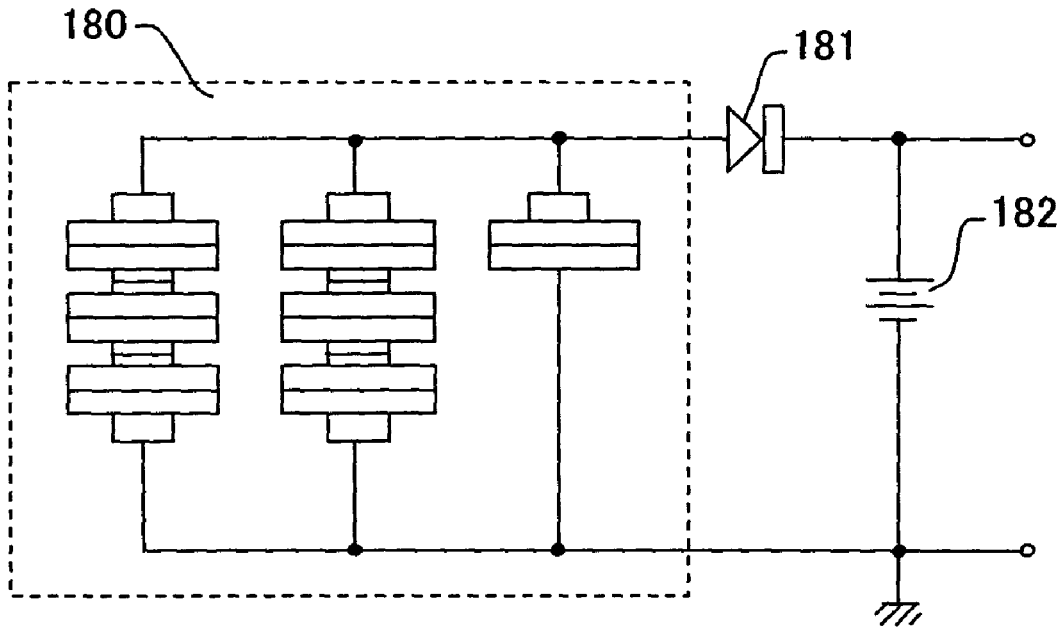
FIG. 16 shows a further power supply circuit applicable to the invention.

In a further modified example of the control circuit shown in FIG. 16, a DC power supply circuit is constituted by a solar panel 180 and a secondary cell 182 for storing power produced by the solar panel 180. The solar panel 180 includes a plurality of solar cell module groups which are juxtaposed in order to obtain a desired amount of output, and is positioned outdoors. Each solar cell module group is constituted by solar cell modules connected in series. An output terminal of the solar panel 180 is connected to the secondary cell 182 via a reverse blocking diode 181 in order that the power produced by the solar panel 180 is stored in the secondary cell 182. The secondary cell 182 is used for the movable racks in order to activate the DC motors, the CPU 150 and so on (shown in FIG. 13).

The foregoing DC power supply may be applicable as a main or subsidiary power supply for the movable racks in order to operate the movable racks with reduced power.

A further embodiment of the invention will be described hereinafter. In an example of FIG. 17, a power-assisted movable rack system comprises four movable racks 301 to 304, which have front and rear wheels 208 at the bottoms thereof, and DC motors 351 to 354 for rotating the wheels 208 which travel on rails on a floor.

Figure 17:
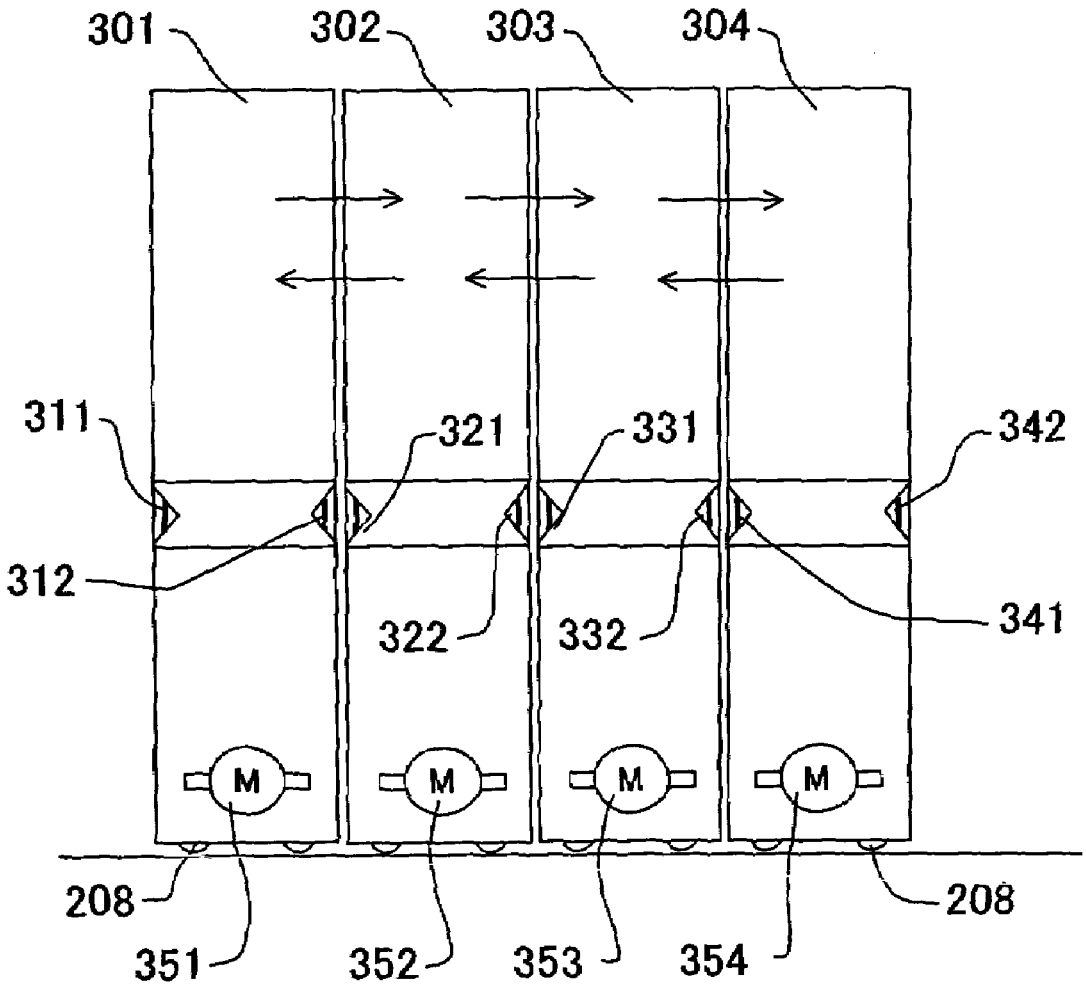
FIG. 17 shows an external appearance of a power-assisted movable racks system including a plurality of movable racks in another example of the invention.

The movable rack 301 includes right and left direction switches 311 and 312. The movable racks 302 to 304 are provided with right and left direction switches 321, 322, 331, 332, 341 and 342, respectively. FIG. 17 shows the side panels of the movable racks 301 to 304, and the right direction switches are positioned at the left sides of the side panels while the left direction switches are positioned at the right sides of the side panels. The direction switches 311, 321, 331 and 341 are operated in order to move the movable racks 301 to 304 to the right while the direction switches 312, 322, 332 and 342 are operated in order to move the movable racks to the left.

Figure 18:
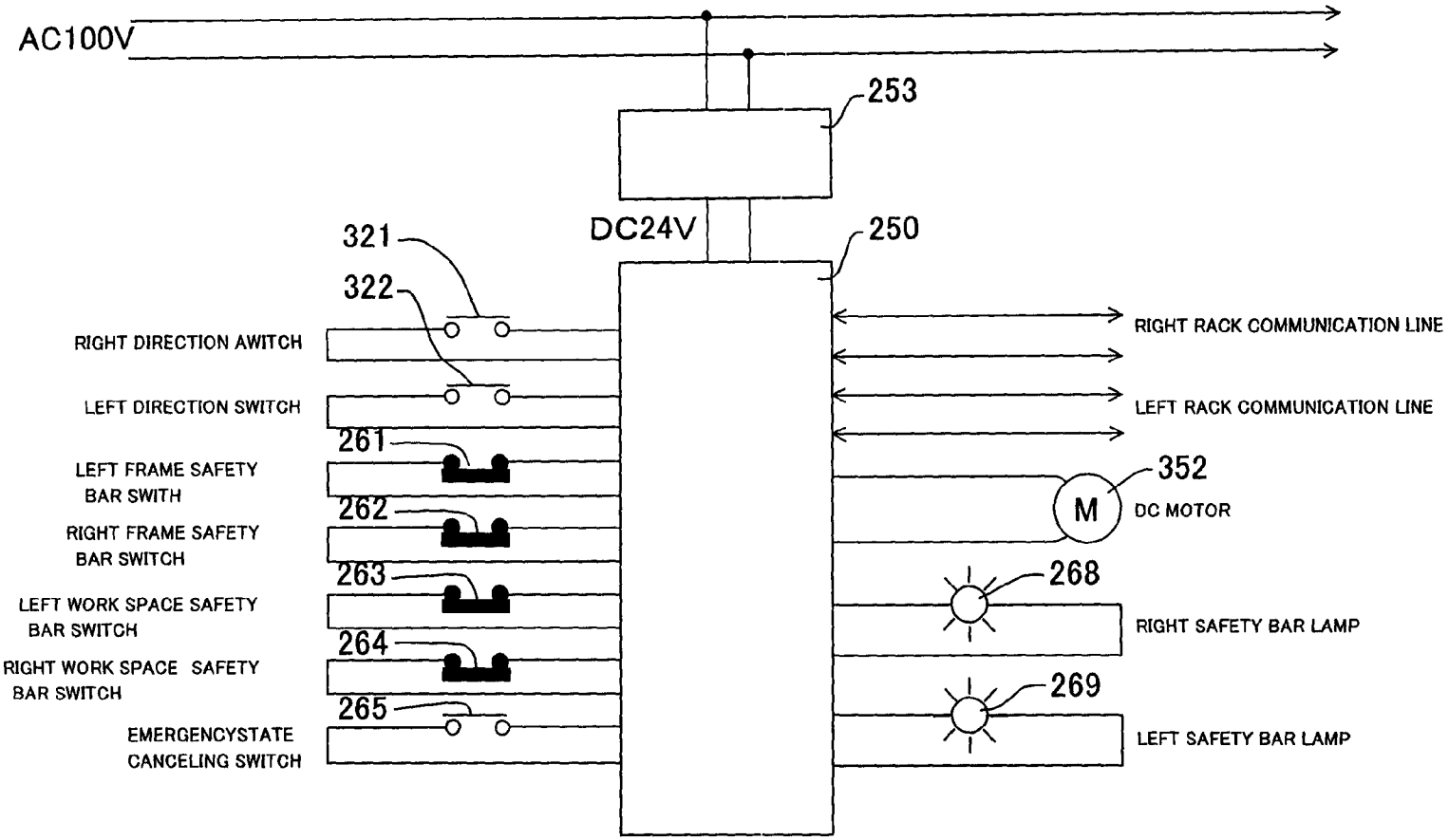
FIG. 18 shows a further control circuit applicable to the invention.

An electric circuit provided in each movable rack will be described with reference to FIG. 18. It should be noted that FIG. 18 shows the electric circuit of the movable rack 302 as an example. The electric circuits of the remaining movable racks are identical to this electric circuit. The electric circuit comprises: a control circuit 250 for controlling the forward and reverse rotations, stopping and braking of a DC motor 252, and being constituted by a micro-computer; and a DC stabilizing power supply 253 for converting commercial AC power into DC 24V power and supplying it to the control circuit 250. The control circuit 250 is connected to the right and left direction switches 321 and 322, left and right frame safety bar switches 261 and 262, left and right work space safety bar switches 263 and 264, and an emergency state canceling switch 265, all of which function as input means.

The left and right frame safety bar switches 261 and 262 are connected to the safety bars attached on the left and right side surfaces of the frames of the movable rack 302. These switches 261 and 262 are operated whenever the safety bars come into contact with an operator or something while movable racks are being moved in order to form a new work space.

The left and right work space safety bar switches 263 and 264 are connected to the safety bars attached on the left and right frontages of one of rack shelves of the movable rack 302. Specifically, when the operator strikes against the left or right safety bar in the work space being formed, the left or right work space safety bar switch 263 or 264 is selectively operated. In this state, all the movable racks made immovable regardless of the operation of any of the left or right direction switch. Further, the safety bar lamp 268 or 269 of the movable rack whose switch 263 or 264 has been operated is turned on in order to indicate that none of the movable racks can be moved.

In an emergency, the operator may intentionally touch any of the foregoing safety bars in order to stop the movable racks. In such a case, either the switch 263 or 264 is activated, thereby stopping the movable racks. The emergency state canceling switch 265 is operated in order to return the emergently stopped movable racks to their original state, and make them movable.

The DC motor 352 and the right and left safety bar lamps 268 and 269 are connected to the control circuit 250 as output members. The control circuit 250 rotates the DC motors 352 forward or backward while either the rightward or leftward signal is being input, stops the DC motor 352 when the leftward or rightward signal is terminated, and applies the dynamic braking to the DC motor 352. Further, the control circuit 250 is provided with an actuating circuit for applying the dynamic braking to the DC motor 352 in response to the emergency stop signal.

In response to the operation of the right direction switch 321, the control circuit 250 of the movable rack 302 controls the actuating circuit, activates the DC motor 352 in order to move the movable rack 302 to the right, and issues the rightward signal. The rightward signal is transmitted to the right movable rack 303 via a right rack communication line. When the left direction switch 322 is operated, the control circuit 250 controls the actuating circuit, activates the DC motor 352 in order to move the movable rack 302 to the left, and issues the leftward signal. The leftward signal is transmitted to the left movable rack 301 via a left rack communication line.

Further, in response to the leftward signal from the movable rack 303 via a right communication line, the control circuit 250 of the movable rack 302 controls the actuating circuit, activates the DC motor 352 in order to move the movable rack 302 to the left, and issues the leftward signal. The leftward signal is transmitted to the left movable rack 301 via a left rack communication line. Still further, when receiving the rightward signal from the movable rack 301, the control circuit 250 of the movable rack 302 controls the actuating circuit, activates the DC motor 352 in order to move the movable rack 302 to the right, and issues the rightward signal, which is transmitted to the movable rack 303 via a right rack communication line.

The control circuit of each movable rack controls the actuating circuit in order to operate the DC motor of the movable rack at the rated output when the right or left direction switch is operated thereon. Further, when a driven movable rack receives the rightward or leftward signal from a driving movable rack, the control circuit of the driven movable rack controls the actuating circuit in order that the DC motor of the driven movable rack is operated by power which is smaller than that by which the driving movable rack is moved, or smaller than that by which the driven movable rack cannot move by itself. The rated output of each DC motor is obtained by applying the 24V–8A current while the power by which the driven movable rack cannot move by itself is obtained by applying approximately 24V–6A current.

Figure 21:
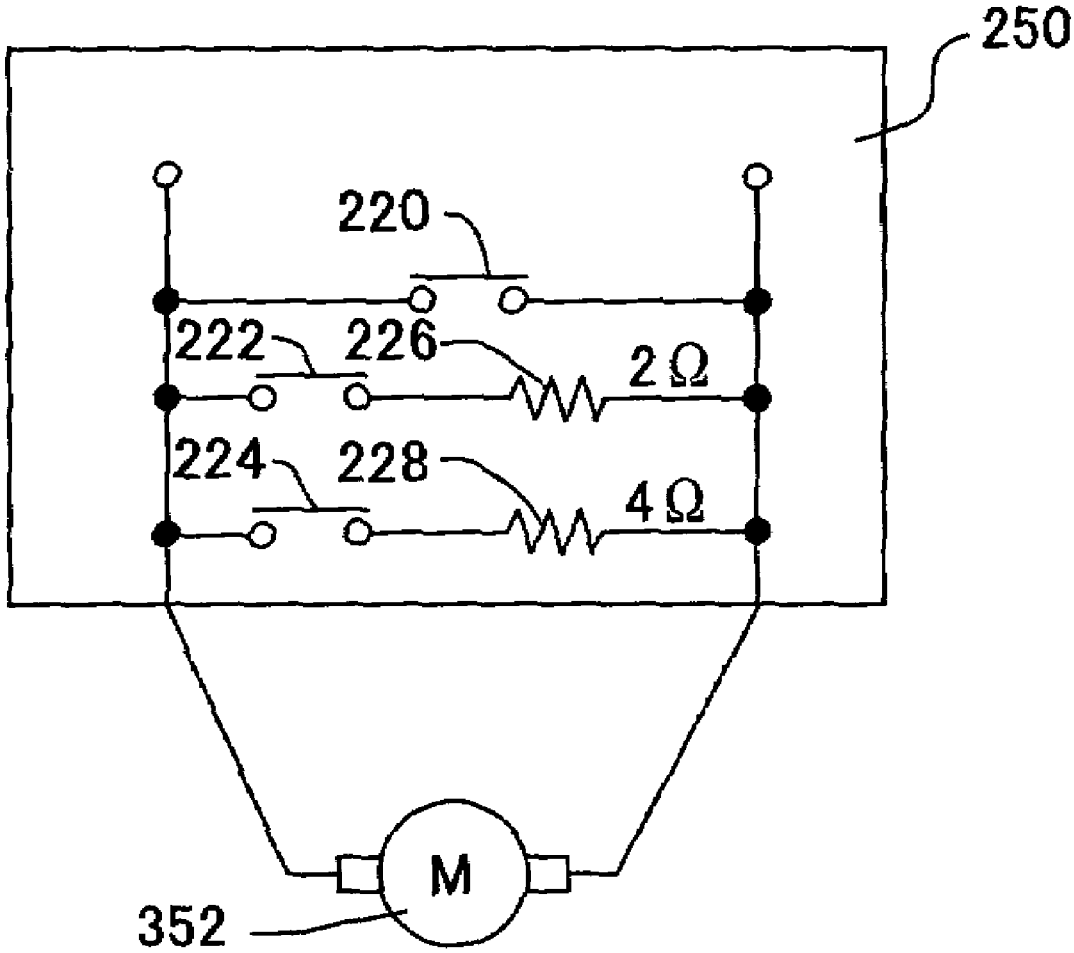
FIG. 21 shows a brake circuit applicable to the invention.

The actuating circuit of each control circuit also includes a dynamic braking force producing circuit for stopping the movable racks. FIG. 21 shows an example of the braking force producing circuit for the movable rack 302. The actuating circuit provides power to terminals of the DC motor 352 in order to rotate it forward or backward as described above. A switch 220 is provided via a 2 Ω resistor between the terminals of the DC motor 352 in order to short-circuit the terminals, and serves as one of dynamic braking force generating circuits. Further, a switch 224 is provided via a 4 Ω resistor between the terminals. The switches 220, 222 and 224 are relay switches or thyristors which are turned on and off by the control circuit 250.

The movable racks 301 to 304 include circuits which are identical to those shown in FIGS. 18 and 21.

Figure 24:
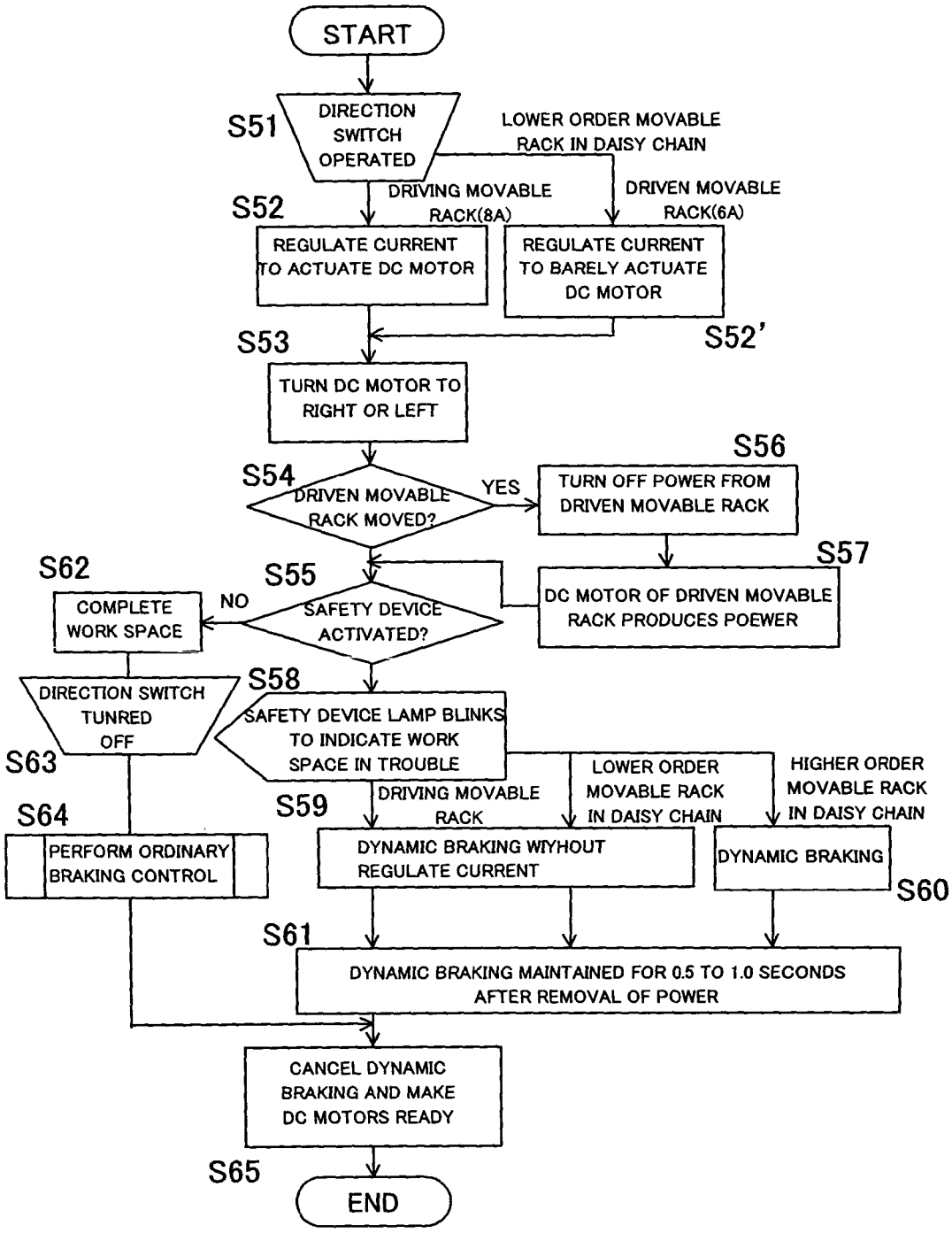
FIG. 24 is a flowchart showing a further braking operation in the power-assisted movable rack system.
Figure 25:
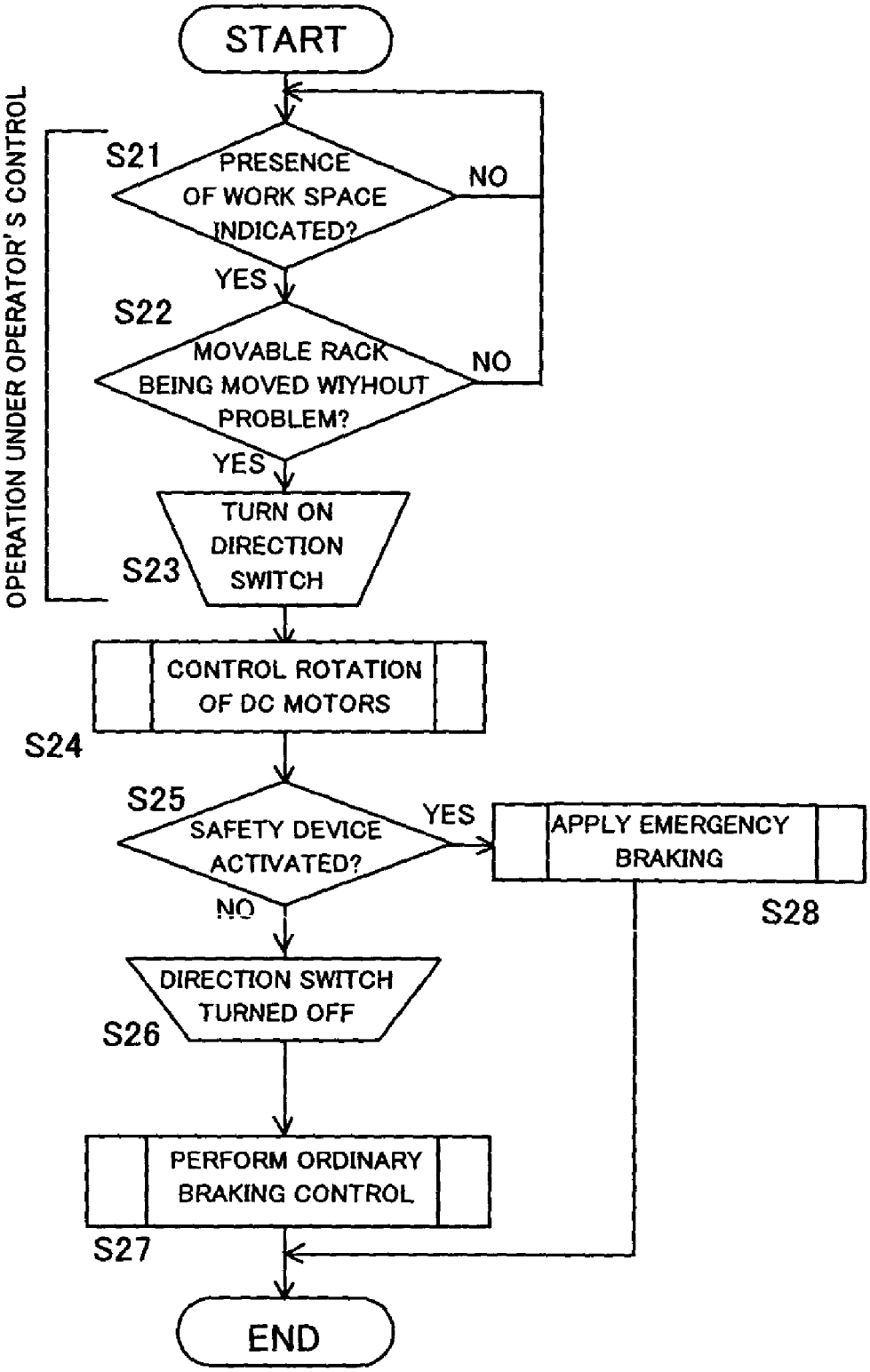
FIG. 25 is a flow chart showing a still further braking operation in the power-assisted movable rack system.

The operation of the foregoing embodiment will be described with reference to FIGS. 23 to 25. Referring to FIG. 25, it is checked by the operator (step S21) whether or not the presence of a work space is indicated. If not, it is considered that no work is being carried out between the movable racks. It is checked (step S22) whether or not movable racks can be moved without any problem. If not, either right or left direction switch 321 or 322 is operated (step S23). In this state, the DC motor 352 is actuated and controlled, so that the movable rack 302 is moved to the right or left (step S24), as will be described in detail later.

In this state, the operation of the safety device is checked (step S25), i.e. it is checked whether any one of the left and right frame safety bar switches 261 and 262 and the left and right work space safety bar switches 263 and 264 of the movable rack 302 is operated. If not, the movable rack 301 keeps on moving until the right or left direction switch 321 or 322 is turned off (step S26), and is stopped when the foregoing switch is released, as the normal braking operation (step S27) (to be described in detail later). On the contrary, if the safety device is operated (step S28), the movable rack 301 is immediately stopped, as will be described in detail later.

Figure 23:
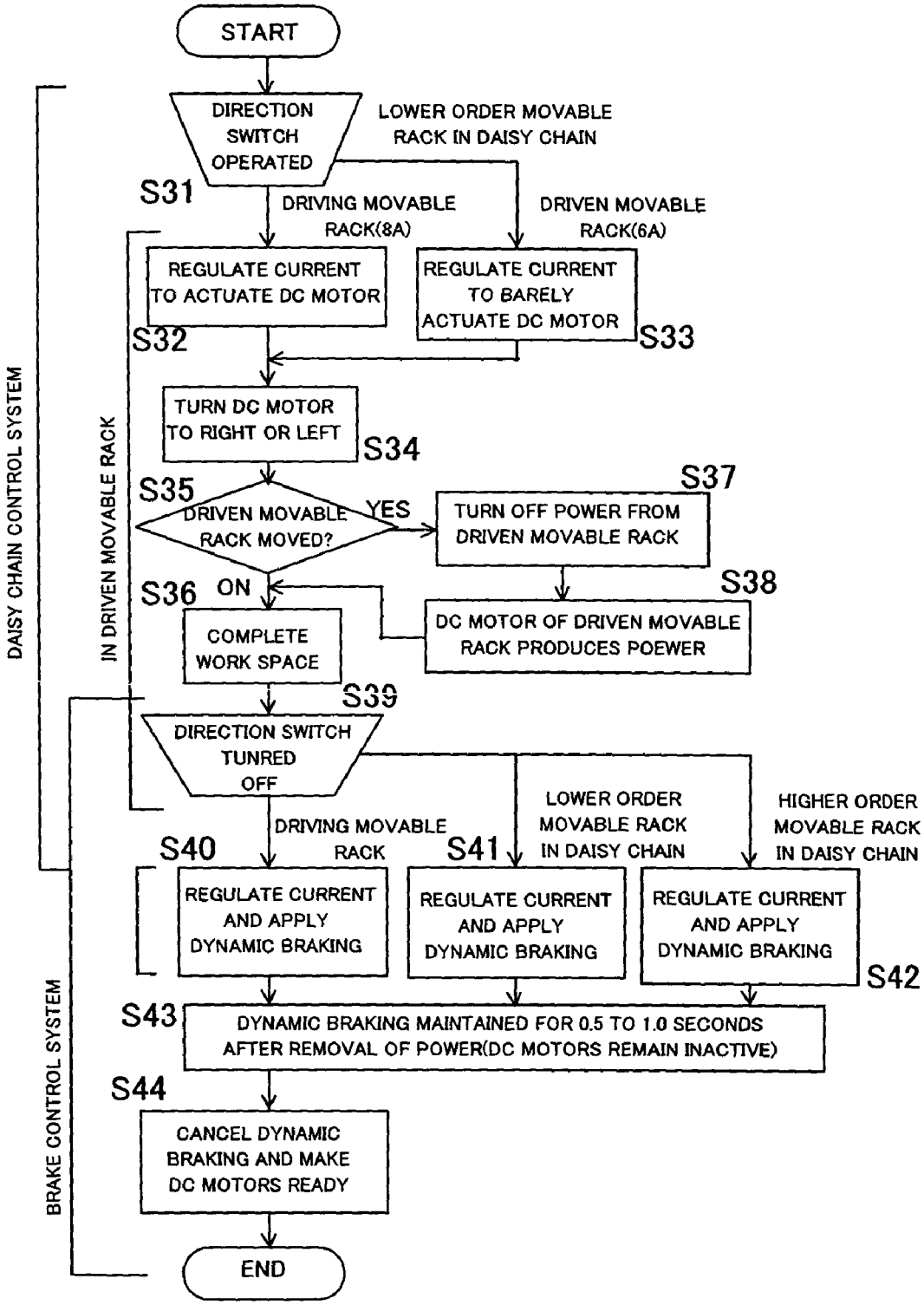
FIG. 23 is a flowchart showing a braking operation in the power-assisted movable rack system.

Referring to FIG. 23, when either the right or right direction switch is found to be active (step S31), a current to be supplied to a DC motor of the movable rack whose switch has been turned on (this movable rack being called the "driving movable rack") is controlled in order to actuate the electric motor of the driving movable rack, e.g. an 8A current is supplied in this case (step S32). A 6A current is introduced into a driven movable rack (i.e. a "lower order movable rack" in a daisy chain and called the "driven movable rack") which is pushed by the driving movable rack. This current is smaller than the current supplied to the DC motor of the driving movable rack, e.g. a current which is slightly insufficient to move the driven movable rack. The DC motor of the driving movable rack is rotated forward or backward (step S34), thereby moving the driven movable rack which is right or left to the driving movable rack.

In step S35, it is checked whether or not the driving movable rack has moved the driven movable rack. Power supplied to the DC motor of the driven movable rack is turned off (step S38). Rotary force of the wheels of the driving movable rack is transmitted to the electric motor of the wheels of the driven movable rack, so that the DC motor is rotated in order to generate power (step S38). Both the driving and driven movable racks are actuated and moved for the predetermined distances, thereby forming the work space (step S36). The operator determines the timing to turn off the left or right direction switch, and inactivates the switch (step 39).

Power supplied to the driving movable rack is suspended, so that the DC motor of the driven movable rack is stopped or those of a plurality of driven motors are stopped. In the driving movable rack, the terminals of the DC motor are connected via an appropriate resistor in order to regulate the generated current and apply the dynamic braking to the DC motor (step S40). In the driven movable rack, the terminals of the DC motor are connected via an appropriate resistor in order to regulate the generated current and apply the dynamic braking to the DC motor (step S41). The remaining stationary movable racks which and have higher orders in the daisy chain are braked by regulating the current (step S42). Actually speaking, no braking force is produced because no power has been produced. Usually, the movable racks are stopped by applying braking force by turning off the right or left direction switch, which is called normal braking control.

The dynamic braking force varies with the sizes of articles stored in the movable racks, so that the movable racks can be stopped within a substantially constant distance even if articles loaded therein vary. In other words, the larger the load, the larger the inertia force, the more power is generated, and the larger the dynamic braking force. Conversely, the smaller the load, the smaller the inertia force, and the smaller the generated power and the dynamic braking force.

When the dynamic braking is applied, the movable racks are immediately stopped. Thereafter, the motor terminals are shorted for approximately 0.1 second to 1.0 second in order to maintain the braked state (step S43). During the dynamic braking, no current is applied to the DC motors. Thereafter, the foregoing state will be canceled, and the DC motors may become ready, so that the movable rack system will become ready for a next operation.

The emergency braking control will be described with reference to FIG. 24. In FIG. 24, steps S51 to S54 are identical to the steps S31 to S35 shown in FIG. 23. Further, steps S56 and S57 in FIG. 24 are identical to the steps S37 and S38 in FIG. 23. It is assumed here that one driving movable rack pushes a plurality of driven movable racks. It is checked in step S55 whether or not the safety device is active, i.e. whether or not the left or right frame safety bar switch 261 or 262, or the left or right work space safety bar switch 263 or 264 is active. If the safety device is found to be active, either the left or right safety device lamp 268 or 269 is turned on. Otherwise, one of the direction switches remains depressed. When a work space of a desired size is completed (step S62), the direction switch is turned off (step S63) in order to stop the movable racks (step S64) as described previously.

If the safety device is found active in step S55, the corresponding safety device lamp 268 or 269 blinks in order to indicate the activation of the safety device (step S58), and dynamic braking is applied to the movable racks without regulating the power generated by the DC motors (step S59). Since the emergency stop signal has been issued in this case, the switch 220 (shown in FIG. 21) is turned on, the terminals of the DC motors 352 are shorted, and the DC motors are inactivated using maximum dynamic braking force, which stop not only the driving movable rack but also the driven movable racks. Further, dynamic braking will be applied to the stationary movable racks, i.e. higher order movable racks in the daisy chain (step S60).

The succeeding operation is identical to the operation for which the normal dynamic braking is applied. In response to the dynamic braking, all the movable racks are promptly stopped. Thereafter, the motor terminals remain shorted for 0.1 second to 1.0 second, i.e. the dynamic braking is maintained (step S61). Then, this state is canceled, the DC motors become ready, and a series of operations is completed for preparation of the succeeding operation.

In the foregoing embodiments, the dynamic braking is applied to the DC motors when movable racks should be stopped. Movable racks filled with heavy articles can be stopped in short stopping distances. Therefore, the movable racks can stop moving in a relatively uniform stopping distance and with relatively equal spaces maintained therebetween.

Figure 26:
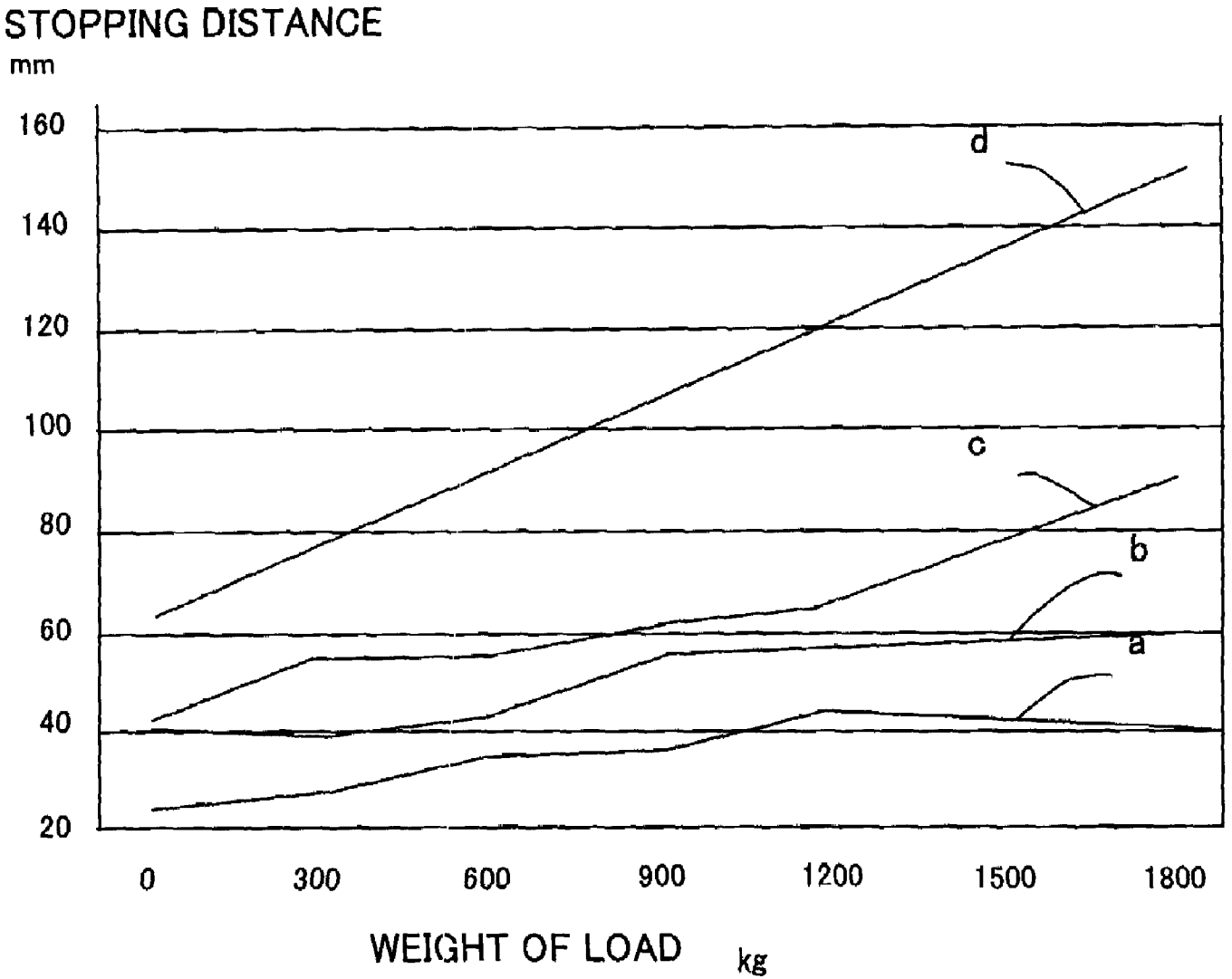
FIG. 26 is a graph showing the relationship between stopping distances and weight of load when the movable rack systems include the braking device of the related art and the braking device of the invention.

FIG. 26 shows the comparison between stopping distances required for the dynamic braking, and stopping distances required for braking movable racks using AC motors as a driving source in the related art. Line a represents a stopping distance when the dynamic braking is applied via a 2 Ω resistor with terminals of a DC motor shorted, line b represents a stopping distance when the dynamic braking is applied via a 3 Ω resistor with the terminals of the DC motor shorted, and line c represents a stopping distance when the dynamic braking is applied via a 4 Ω resistor with the terminals of the DC motor shorted. Line d represents a stopping distance required for braking movable racks using AC motors in the related art. As can be clearly understood on the basis of line d, the stopping distance is long in the related art compared with the present invention. Further, the heavier the load on a movable rack, the longer the stopping distance. With the present invention in which the dynamic braking is applied to the DC motors, the stopping distances are increased according to weight of load but are relatively short as a whole. In other words, the stopping distances do not usually depend upon the weight of load. Needless to say, the smaller the space between motor terminals, the larger the dynamic braking force, which is effective in reducing the stopping distances.

According to the invention, the dynamic braking is applicable to driven movable racks which are pushed by the driving movable rack. As a result, the power-assisted movable racks can be stopped quickly with substantially equal spaces maintained therebetween.

Figure 19:
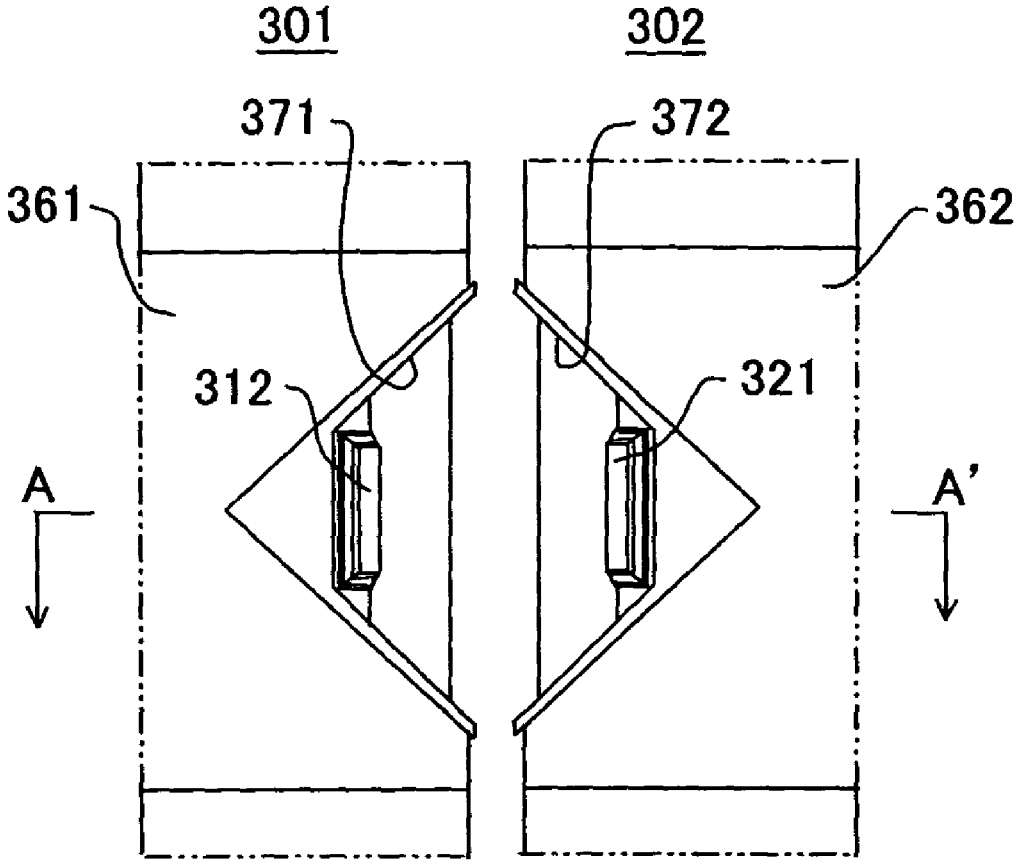
FIG. 19 is a side elevation of a switch applicable to the invention.
Figure 20:
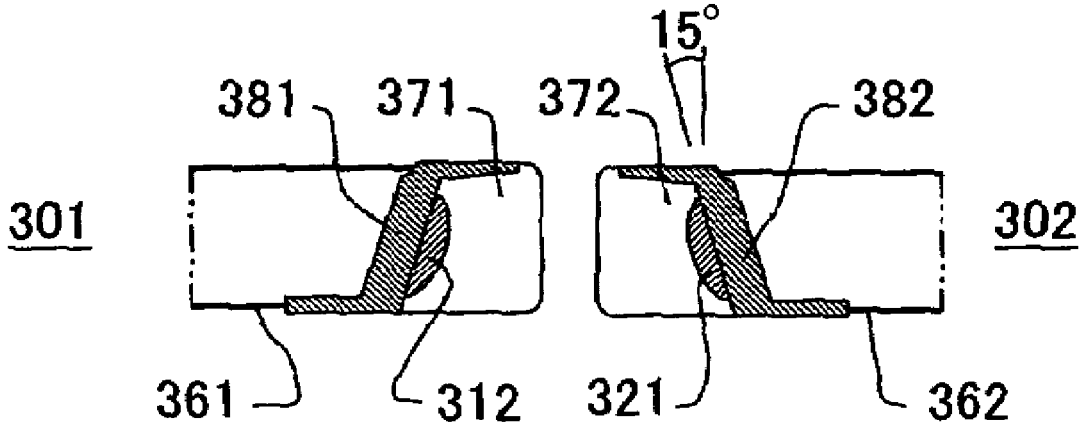
FIG. 20 is a top plan view of the switch shown in FIG. 19.

In the foregoing embodiments, the DC motors of the power-assisted movable racks are rotated forward or backward in response to the operation of the right or left direction switch. The right and left direction switches should be easily operated only when necessary, but should be prevented from being incidentally operated. FIGS. 19 and 20 show right and left direction switches 321 and 312 which are designed in order to meet the foregoing requirements.

Referring to FIGS. 19 and 20, the movable racks 301 and 302 are positioned side by side and have notches 371 and 372 on their side panels 361 and 362, respectively. Switch panels 381 and 382 are fitted in the notches 371 and 372, and are not flush with the frontages of the movable 301 and 302 but are inclined by approximately 15 degrees. The right and left direction switches 312 and 321 are attached on the switch panels 381 and 382, respectively, are inclined with respect to the frontages, and can be easily operated. Further, the right and left direction switches 312 and 321 do not project out of the side panels 361 and 362. Therefore, these direction switches 312 and 321 are prevented from being incidentally operated.

Further, the right and left direction switches 312 and 321 are fitted in the notches 371 and 372, and are back from the frontages of the movable racks 301 and 302. Therefore, even when the movable racks 301 and 302 are close to each other, the right and left direction switches 312 and 321 can be operated via a gap present therebetween.

The right and left direction switches 312 and 321 may be inclined by 0 degrees to 75 degrees, preferably by 10 degrees to 45 degrees, with respect to the frontages of the movable racks 301 and 302. Further, these switches may be preferably positioned at a level of 1000 mm, and may be 300 mm to 1800 mm, from the floor.

The invention is advantageous in that the power-assisted movable rack system can reduce stopping distances and maintain substantially equal spaces between the movable racks. However, the power-assisted movable racks themselves should be mechanically structured in order to maintain substantially equal spaces therebetween. For instance, a movable rack may be twisted and lean to the right or left because the wheels may turn at different speeds due to non-uniform load or some mechanical problem. A space may be enlarged between an adjacent movable rack and such a movable rack when it is stopped.

In order to overcome this problem, wheels of the movable rack are attached to a frame, and are coupled using shafts. A power transmission is positioned at the center of at least one of the shafts, as shown in FIG. 22.

Figure 22:
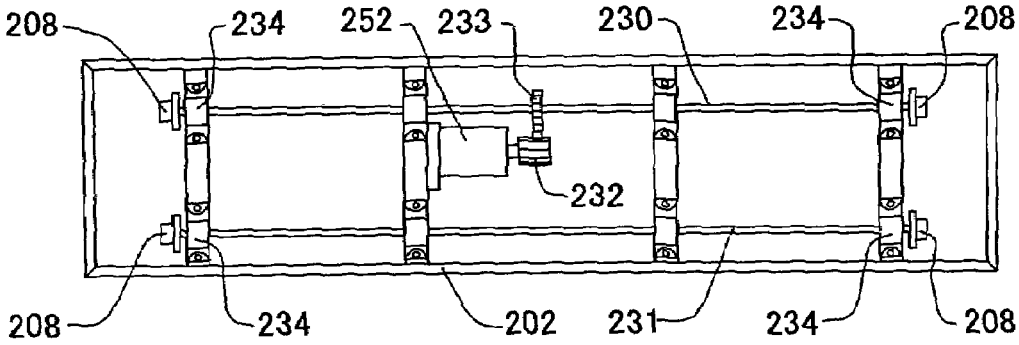
FIG. 22 is a bottom plan view of the movable rack, showing a wheel moving mechanism.

Referring to FIG. 22, a frame of one movable rack includes one pair each of front and rear wheels 208 along the moving direction of the movable rack. The front wheels 208 are coupled by a rotary shaft 230 while the rear wheels 208 are coupled by a rotary shaft 231. In other words, the wheels 208 are present at the opposite ends of the rotary shafts 230 and 231. The rotary shafts 230 and 231 are rotatably supported by a plurality of bearings 234 which are attached to beams constituting the frame. A gear 233 as the power transmission is disposed at the center of the rotary shaft 230 extending between the wheels 208. The gear 233 is engaged with a small gear 232 fixedly attached to an output shaft of a DC motor 252. Alternatively, the power transmission may be constituted by a chain and sprocket, a worm and a worm wheel, or the like.

With the foregoing structure, the wheels 208 are substantially equally spaced from the power transmission at the center of the shaft 230. Therefore, when power is transmitted from the DC motor 252 to the shaft 230, the shaft 230 is equally twisted at the opposite ends thereof, so that the movable rack can move smoothly and in a balanced state on the rails without leaning, and can have a uniform space from an adjacent movable rack.

Needless to say, the driven wheels 208 (shown at the lower side in FIG. 22) are not always required to be coupled using a continuous shaft (correspond to the shaft 231 in FIG. 22).

The structure shown in FIG. 22 is applicable to all of the movable racks constituting the movable rack system.

INDUSTRIAL APPLICABILITY

According to the invention, the power-assisted movable rack system comprises a plurality of movable racks. Each of the movable racks includes, a plurality of wheels, the DC motor turning forward or backward and reciprocating the movable rack, a pair of direction switches provided at opposite positions in moving directions of the movable rack, and the actuating circuit rotating the DC motor in one direction during the operation of one of the direction switches and rotating the DC motor in an opposite direction during the operation of the other direction switch.

An operator can move movable racks in opposite directions by operating direction switches as he or she desires.

The DC motor functioning as a drive source has a maximum start torque and can activate movable racks without increasing a speed reduction ratio, so that movable racks can be moved at a high speed. Further, the DC motor can apply maximum dynamic braking to movable racks, which enables the movable racks to stop with a short braking distance.

In a movable rack where either the left or right direction switch is operated, the DC motor associated with the operated switch is actuated in order to move the movable rack (functioning as a driving movable rack) to the left or right. A movable rack which is left or right to the driving movable rack is also moved. Power which is smaller than that applied to the driving movable rack is applied to the movable rack moved by the driving movable rack, so that running torque is generated in the movable rack moved by the driving movable rack. This is effective in reducing loads applied to the DC motor functioning as a drive source.

What is claimed is:

1. A power-assisted movable rack system comprising a plurality of movable racks, each movable rack including:

a plurality of wheels;

a DC motor configured to turn forward or backward and to reciprocate the movable rack;

a pair of right and left direction switches provided at opposite side edges in moving directions of the movable rack; and an actuating circuit configured to rotate the DC motor in one direction during operation of the right direction switch for a purpose of moving the movable rack to the right, and to rotate the DC motor in an opposite direction during operation of the left direction switch for a purpose of moving the movable rack to the left, wherein:

the plurality of movable racks are juxtaposed, and each movable rack is configured to physically move other movable racks;

each movable rack includes a signal transmitter configured to send a rightward signal to a right-driven movable rack when the right direction switch is operated on a driving movable rack, and to send a leftward signal to a left-driven movable rack when the left direction switch is operated on the driving movable rack; and the actuating circuit of the right or the left driven movable rack receiving the rightward or the leftward signal is configured to provide power to the right or the left-driven movable rack receiving the rightward or the leftward signal, the power being smaller than a power applied to the driving movable rack.

2. The movable rack system of claim 1, wherein the actuating circuit of the right or the left driven movable rack receiving the rightward or the leftward signal is configured to provide power to the DC motor of the right or left driven movable rack, the power being smaller than a power insufficient for enabling the driven movable rack to move by itself, and being supplied for a short period of time.

3. The movable rack system of claim 1, wherein dynamic braking is applied to the DC motor when stopping the movable rack; and terminals of the DC motor are shorted in response to an emergency stop signal, and are shorted via a resistor when the right or left direction switch is released for the purpose of stopping the movable rack.

* * * * *